US012326320B2

(12) United States Patent
Batchelder et al.

(10) Patent No.: US 12,326,320 B2
(45) Date of Patent: Jun. 10, 2025

(54) FEED FORWARD IMAGE BASED GUIDANCE

(71) Applicant: BAE Systems Information and Electronic Systems Integration Inc., Nashua, NH (US)

(72) Inventors: Jason H Batchelder, Nashua, NH (US); Matthew F. Chrobak, Groton, MA (US); Tyler Nickerson, Mason, NH (US); Richie Spitsberg, Manchester, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 103 days.

(21) Appl. No.: 18/344,362

(22) Filed: Jun. 29, 2023

(65) Prior Publication Data

US 2025/0003716 A1 Jan. 2, 2025

(51) Int. Cl.
*F41G 7/22* (2006.01)

(52) U.S. Cl.
CPC ..... *F41G 7/2253* (2013.01); *F41G 7/2293* (2013.01)

(58) Field of Classification Search
CPC ..... F41G 7/2253; F41G 7/2293
See application file for complete search history.

(56) References Cited

U.S. PATENT DOCUMENTS 4,456,862 A * 6/1984 Yueh ..... G05D 1/12 244/3.17
4,494,202 A * 1/1985 Yueh ..... G05D 1/12 244/3.18
4,502,650 A * 3/1985 Yueh ..... G05D 1/12 244/3.15
5,465,212 A * 11/1995 Fowler ..... F41G 7/007 701/4
6,808,139 B1 * 10/2004 Sturm ..... G05D 1/12 244/3.13
2017/0307334 A1 10/2017 Greenwood
2017/0337829 A1 11/2017 Brandao et al.
(Continued)

FOREIGN PATENT DOCUMENTS

GB 2331352 A * 5/1999 ..... G05D 1/12

OTHER PUBLICATIONS

A. K. Ghosh et al., "Trajectory Modelling of an Artillery Shell using Feed Forward Neural Networks"; IE(I) Journal—AS; vol. 84; Nov. 2003; pp. 47-49. (Year: 2003).*
(Continued)

*Primary Examiner* — Bernarr E Gregory
(74) *Attorney, Agent, or Firm* — Sand, Sebolt & Wernow LPA; Gary McFaline

(57) ABSTRACT

A feed forward guidance kit for a ballistic device that includes at least one optical imaging sensor, a processor that is operatively in communication with the at least one optical imaging sensor, and a feed forward guidance protocol that is stored on a computer readable medium and that is operatively in communication with the processor. When the at least one optical imaging sensor initially intercepts an aircraft at an initial location during combat, the feed forward guidance protocol instructs the processor to proactively calculate an anticipated second position of the aircraft as an orientation of the aircraft changes from an initial orientation to a translated orientation.

20 Claims, 15 Drawing Sheets

(56) References Cited

U.S. PATENT DOCUMENTS

| | | | |
|---|---|---|---|
| 2020/0108924 | A1 | 4/2020 | Smith et al. |
| 2022/0363386 | A1 | 11/2022 | Treadway et al. |

OTHER PUBLICATIONS

Neil F. Palumbo, Ross A. Blauwkamp, and Justin M. Loyd, Modern Homing Missile Guidance Theory and Techniques, Johns Hopkins APL Technical Digest, vol. 29, Nov. 1, 2010, p. 42-59.
International Search Report, PCT/US24/31617, mailed Sep. 12, 2024, 10 pages.

* cited by examiner

FEED FORWARD IMAGE BASED GUIDANCE

TECHNICAL FIELD

The present disclosure generally relates to guidance kits of projectiles, particularly guidance protocols for guidance kits.

BACKGROUND ART

Conventional target projectiles, ballistic device, or missiles include a navigation system for guiding the missile towards a desired target. In one example, proportional navigation (hereinafter ProNav) guidance system is a conventional guidance law used on conventional missiles. Typically, the ProNav guidance system provided on a conventional missile requires a ratio of 3-to-1 maneuver overmatch in comparison to the airborne target. Stated differently, the interceptor and/or missile requires at least three time the maneuverability of the target in order to intercept and strike the airborne target. With such vast differences in maneuverability between the missile and the airborne target, such differences creates a vast maneuver requirement in order for the missile to strike and neutralize the airborne target in a military operation. As such, the missile must include particular propulsion components, flight components, and payload components in order to account for the maneuverability differences between the missile and the target.

To combat the maneuverability differences between the missile and the airborne target, the guidance system provided with this missile takes airborne target acceleration into account when being guided towards the airborne target. However, such target acceleration that is measured by the guidance system is a reactive measurement of the acceleration of the airborne target. Stated differently, the target acceleration measured by conventional sensors of the guidance system is taken subsequent to the airborne target changing in acceleration and position while in flight. Even though these guidance systems may still provide adequate attacks on airborne target, such reactive feedback capabilities of these guidance systems place a burden on and decreases the maneuverability differences between the missile and the airborne target since the missile constantly reacts to the past and/or earlier movements of the airborne target. With such reactive feedback, the maneuverability differences between the missile and the airborne target may remain the same and/or increase unless particular parts and/or components of the missile are modified and/or removed to justify a reasonable maneuverability difference between the missile and the airborne target.

SUMMARY OF THE INVENTION

In one aspect, an exemplary embodiment of the present disclosure may provide a feed forward guidance kit for a ballistic device. The feed forward guidance kit comprises at least one optical imaging sensor, a processor that is operatively in communication with the at least one optical imaging sensor, and a feed forward guidance protocol that is stored on a computer readable medium and that is operatively in communication with the processor. When the at least one optical imaging sensor initially intercepts an aircraft at an initial location, the feed forward guidance protocol instructs the processor instructs the processor to proactively calculate an anticipated second position of the aircraft as an orientation of the aircraft changes from an initial orientation to a translated orientation.

This exemplary embodiment or another exemplary embodiment may further include that the feed forward guidance protocol comprises: an identifier function operatively in communication with the processor and the at least one optical imaging sensor; wherein the identifier function is configured to classify if the aircraft is one of a rotary-wing aircraft and a fixed-wing aircraft. This exemplary embodiment or another exemplary embodiment may further include that the feed forward guidance protocol further comprises: a first set of instructions operatively in communication with the processor; and wherein the first set of instructions is initiated in response to the identifier function determining the aircraft as a fixed-wing aircraft as detected by the at least one optical imaging sensor. This exemplary embodiment or another exemplary embodiment may further include that the first set of instructions of the feed forward guidance protocol further comprises: a first guidance law function operatively in communication with the processor; wherein the first guidance law function is initiated in response to the identifier function establishing the aircraft as the fixed-wing aircraft; and wherein the first guidance law function loads the processor with a fixed-wing guidance law. This exemplary embodiment or another exemplary embodiment may further include that the first set of instructions of the feed forward guidance protocol further comprises: a first orientation function operatively in communication with the processor; wherein the first orientation law function is initiated in response to the identifier function establishing the aircraft as the fixed-wing aircraft; wherein the first orientation function instructs the processor to measure the orientation of the aircraft as the aircraft changes from the initial orientation to the translated orientation. This exemplary embodiment or another exemplary embodiment may further include that the first set of instructions of the feed forward guidance protocol further comprises: a first guidance function operatively in communication with the processor; wherein the first guidance function is initiated in response to the first orientation function proactively calculating the anticipated second position of the aircraft; wherein the first guidance function instructs the processor to proactively calculate the anticipated second position of the aircraft as the orientation of the aircraft changes from the initial orientation to the translated orientation. This exemplary embodiment or another exemplary embodiment may further include that the feed forward guidance protocol further comprises: a second set of instructions operatively in communication with the processor; wherein the second set of instructions is initiated in response to the identifier function determining the aircraft as a rotary-wing aircraft as detected by the at least one optical imaging sensor. This exemplary embodiment or another exemplary embodiment may further include that the second set of instructions of the feed forward guidance protocol further comprises: a second guidance law function operatively in communication with the processor; wherein the second guidance law function is initiated in response to the identifier function establishing the aircraft as the rotary-wing aircraft; and wherein the second guidance law function loads the processor with a rotary-wing guidance law. This exemplary embodiment or another exemplary embodiment may further include that the second set of instructions of the feed forward guidance protocol further comprises: a second orientation function operatively in communication with the processor; wherein the second orientation law function is initiated in response to the identifier function establishing the aircraft as the rotary-wing aircraft; wherein the second orientation function instructs the processor to measure the orientation of the aircraft as the aircraft changes from the initial orientation to the translated orientation. This exemplary embodiment or another exemplary embodiment may further include that the second set of instructions of the feed forward guidance protocol further comprises: a second guidance function operatively in communication with the processor; wherein the second guidance function is initiated in response to the second orientation function proactively calculating the anticipated second position of the aircraft; wherein the second guidance function instructs the processor to proactively calculate the anticipated second position of the aircraft as the orientation of the aircraft changes from the initial orientation to the translated orientation.

In another aspect, an exemplary embodiment of the present disclosure may provide a method for proactively guiding a ballistic device to an anticipated location of an aircraft. The method includes step of: providing a feed forward guidance kit with the ballistic device, the feed forward guidance kit comprises: at least one optical imaging sensor; a processor operatively in communication with the at least one optical imaging sensor and the guidance kit; and a feed forward guidance protocol stored on a computer readable medium that is operatively in communication with the processor; effecting the at least one optical imaging sensor to detect the aircraft at an initial position; effecting the at least one optical imaging sensor to output an image of the aircraft to the processor; effecting the feed forward guidance protocol to be initiated by receiving the image of the aircraft; and effecting the feed forward guidance protocol to proactively guide the ballistic device to an anticipated location of the aircraft as an orientation of the aircraft changes from an initial orientation to a translated orientation.

This exemplary embodiment or another exemplary embodiment may further include steps of effecting an identifier function of the feed forward guidance protocol to be initiated, via the processor, in response to receiving the image of the aircraft; and effecting the identifier function of the feed forward guidance protocol to determine if the aircraft is one of a rotary-wing aircraft and a fixed-wing aircraft based on the image received. This exemplary embodiment or another exemplary embodiment may further include a step of effecting a first set of instructions of the feed forward guidance protocol, via the identifier function, to be initiated by the processor. This exemplary embodiment or another exemplary embodiment may further include a step of effecting a first guidance law function of the first set of instructions to load the processor with a fixed-wing guidance law. This exemplary embodiment or another exemplary embodiment may further include a step of effecting an first orientation function of the first set of instructions to measure the orientation of the aircraft as the aircraft changes from the initial orientation to the translated orientation. This exemplary embodiment or another exemplary embodiment may further include a step of effecting a first guidance function of the first set of instructions to proactively calculate the anticipated second position to the processor for guiding the ballistic device to the anticipated second position. This exemplary embodiment or another exemplary embodiment may further include a step of effecting a second set of instructions of the feed forward guidance protocol, via the identifier function, to be initiated by the processor. This exemplary embodiment or another exemplary embodiment may further include a step of effecting a second guidance law function of the second set of instructions to load the processor with a rotary-wing guidance law. This exemplary embodiment or another exemplary embodiment may further include a step of effecting a second orientation function of the second set of instructions to measure the orientation of the aircraft as the aircraft changes from the initial orientation to the translated orientation. This exemplary embodiment or another exemplary embodiment may further include a step of effecting a second guidance function of the second set of instructions to proactively calculate the anticipated second position to the processor for guiding the missile to the anticipated second position.

In yet another aspect, an exemplary embodiment of the present disclosure may provide a feed forward guidance kit for a ballistic device. The feed forward guidance kit includes at least one optical imaging sensor, a processor that is operatively in communication with the at least one optical imaging sensor, and a feed forward guidance protocol that is stored on a computer readable medium and that is executable by the processor. When the at least one optical imaging sensor initially intercepts an aircraft at an initial position, the processor accesses the feed forward guidance protocol to proactively calculate an anticipated second position of the aircraft as an orientation of the aircraft changes from an initial orientation to a translated orientation and based on the type of aircraft intercepted by the optical imaging sensor.

This exemplary embodiment or another exemplary embodiment may further include that the feed forward guidance protocol comprises: an identifier function stored on the computer readable medium and executable by the processor to classify if the aircraft is one of a rotary-wing aircraft and a fixed-wing aircraft. This exemplary embodiment or another exemplary embodiment may further include that the feed forward guidance protocol further comprises: a guidance law function of a first set of instructions stored on the computer readable medium and executable by the processor in response to the identifier function identifying the aircraft as the fixed-wing aircraft; wherein the guidance law function of the first set of instructions comprises of a set of fixed-wing guidance laws. This exemplary embodiment or another exemplary embodiment may further include that the feed forward guidance protocol further comprises: an orientation function of the first set of instructions stored on the computer readable medium and executable by the processor in response to the identifier function identifying the aircraft as the fixed-wing aircraft; wherein the orientation function of the first set of instructions instructs the processor to measure the orientation of the fixed-wing aircraft as the fixed-wing aircraft changes from the initial orientation to the translated orientation. This exemplary embodiment or another exemplary embodiment may further include that the feed forward guidance protocol further comprises: a guidance function of the first set of instructions stored on the computer readable medium and executable by the processor in response to the orientation function measuring the orientation of the fixed-wing aircraft; wherein the guidance function of the first set of instructions instructs the processor to proactively calculate the anticipated second position of the fixed-wing aircraft as the orientation of the fixed-wing aircraft changes from the initial orientation to the translated orientation. This exemplary embodiment or another exemplary embodiment may further include that the feed forward guidance protocol further comprises: a guidance law function of a second set of instructions stored on the computer readable medium and executable by the processor in response to the identifier function identifying the aircraft as the rotary-wing aircraft; wherein the guidance law function of the second set of instructions comprises of a set of rotary-wing guidance laws. This exemplary embodiment or another exemplary embodiment may further include that the feed forward guidance protocol further comprises: an orientation function of the second set of instructions stored on the computer readable medium and executable by the processor in response to the identifier function identifying the aircraft as the rotary-wing aircraft; wherein the orientation function of the second set of instructions instructs the processor to measure the orientation of the rotary-wing aircraft as the rotary-wing aircraft changes from the initial orientation to the translated orientation. This exemplary embodiment or another exemplary embodiment may further include that the feed forward guidance protocol further comprises: a guidance function of the second set of instructions stored on the computer readable medium and executable by the processor in response to the orientation function measuring the orientation of the rotary-wing aircraft; wherein the guidance function of the second set of instructions instructs the processor to proactively calculate the anticipated second position of the rotary-wing aircraft as the orientation of the rotary-wing aircraft changes from the initial orientation to the translated orientation.

In yet another aspect, an exemplary embodiment of the present disclosure may provide a method for enhancing target engagement of a ballistic projectile. The method comprises steps of providing a ballistic projectile having at least one optical imaging sensor and a processor operatively in communication with the at least one optical imaging sensor, wherein the processor is configured to execute a feed forward guidance protocol loaded on a computer readable medium which, when executed by the processor, causes the processor to: command the at least one optical image sensor to detect a targeted aircraft; receive an image of the targeted aircraft at an initial orientation outputted by the at least one optical imaging sensor; and proactively guide the ballistic projectile to an anticipated position of the targeted aircraft as the orientation of the targeted aircraft changes from the initial orientation to a translated orientation.

This exemplary embodiment or another exemplary embodiment may further include that when the feed forward guidance protocol is executed by the processor, the processor is further caused to: classify if the targeted aircraft is one of a rotary-wing aircraft and a fixed-wing aircraft upon executing an identifier function loaded on the computer readable medium. This exemplary embodiment or another exemplary embodiment may further include that when the feed forward guidance protocol is executed by the processor, the processor is further caused to: load a set of guidance laws corresponding to the fixed-wing aircraft when identified by execution of the identifier function. This exemplary embodiment or another exemplary embodiment may further include that when the feed forward guidance protocol is executed by the processor, the processor is further caused to: load an orientation law corresponding to the fixed-wing aircraft when identified by execution of the identifier function; and measure the orientation of the fixed-wing aircraft as the fixed-wing aircraft changes from the initial orientation to the translated orientation. This exemplary embodiment or another exemplary embodiment may further include that when the feed forward guidance protocol is executed by the processor, the processor is further caused to: load a guidance function to proactively calculate the anticipated position of the fixed-wing aircraft as the orientation of the fixed-wing aircraft changes from the initial orientation to the translated orientation. This exemplary embodiment or another exemplary embodiment may further include that when the feed forward guidance protocol is executed by the processor, the processor is further caused to: load a set of guidance laws corresponding to the rotary-wing aircraft when identified by execution of the identifier function. This exemplary embodiment or another exemplary embodiment may further include that when the feed forward guidance protocol is executed by the processor, the processor is further caused to: load an orientation law corresponding to the rotary-wing aircraft when identified by execution of the identifier function; and measure the orientation of the rotary-wing aircraft as the rotary-wing aircraft changes from the initial orientation to the translated orientation. This exemplary embodiment or another exemplary embodiment may further include that when the feed forward guidance protocol is executed by the processor, the processor is further caused to: load a guidance function to proactively calculate the anticipated position of the rotary-wing aircraft as the orientation of the rotary-wing aircraft changes from the initial orientation to the translated orientation.

In yet another aspect, an exemplary embodiment of the present disclosure may provide a computer-implemented method stored on a computer readable medium and executable by a processor on a ballistic device. The computer-implemented method comprises of: executing, by the processor, a first step of the computer-implemented method stored on the computer readable medium that instructs the processor to classify the type of aircraft intercepted by at least one optical imaging sensor of the ballistic device; executing, by the processor, a second step of the computer-implemented method stored on the computer readable medium that comprises of at least one set of guidance laws corresponding to the type of aircraft identified by the first step; executing, by the processor, a third step of the computer-implemented method stored on the computer readable medium that comprises at least one orientation law corresponding to the type of aircraft identified by the identifier function to instruct the processor to measure the orientation of the aircraft as the aircraft changes from an initial orientation to a translated orientation; and executing, by the processor, a fourth step of the computer-implemented method stored on the computer readable medium that comprises of at least one guidance function to instruct the processor to proactively calculate an anticipated position of the aircraft as the orientation of the aircraft changes from the initial orientation to the translated orientation.

This exemplary embodiment or another exemplary embodiment may further include steps of executing, by the processor, the second step of the computer-implemented method stored on the computer readable medium that comprises a first set of guidance laws corresponding to a fixed-wing aircraft identified by the first step; or executing, by the processor, the second step of the computer-implemented method stored on the computer readable medium that comprises a second set of guidance laws corresponding to a rotary-wing aircraft identified by the first step. This exemplary embodiment or another exemplary embodiment may further include steps of executing, by the processor, the third step of the computer-implemented method stored on the computer readable medium that comprises a first orientation law corresponding to a fixed-wing aircraft identified by the first step to instruct the processor to measure the orientation of the fixed-wing aircraft as the fixed-wing aircraft changes from the initial orientation to the translated orientation; or executing, by the processor, the third step of the computer-implemented method stored on the computer readable medium that comprises a second orientation law corresponding to a rotary-wing aircraft identified by the first step to instruct the processor to measure the orientation of the rotary-wing aircraft as the rotary-wing aircraft changes from the initial orientation to the translated orientation. This exemplary embodiment or another exemplary embodiment may further include steps of executing, by the processor, the fourth step of the computer-implemented method stored on the computer readable medium that comprises a first guidance function to instruct the processor to proactively calculate an anticipated position of a fixed-wing aircraft as the orientation of the fixed-wing aircraft changes from the initial orientation to the translated orientation; or executing, by the processor, the fourth step of the computer-implemented method stored on the computer readable medium that comprises a second guidance function to instruct the processor to proactively calculate an anticipated position of a rotary-wing aircraft as the orientation of the rotary-wing aircraft changes from the initial orientation to the translated orientation.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
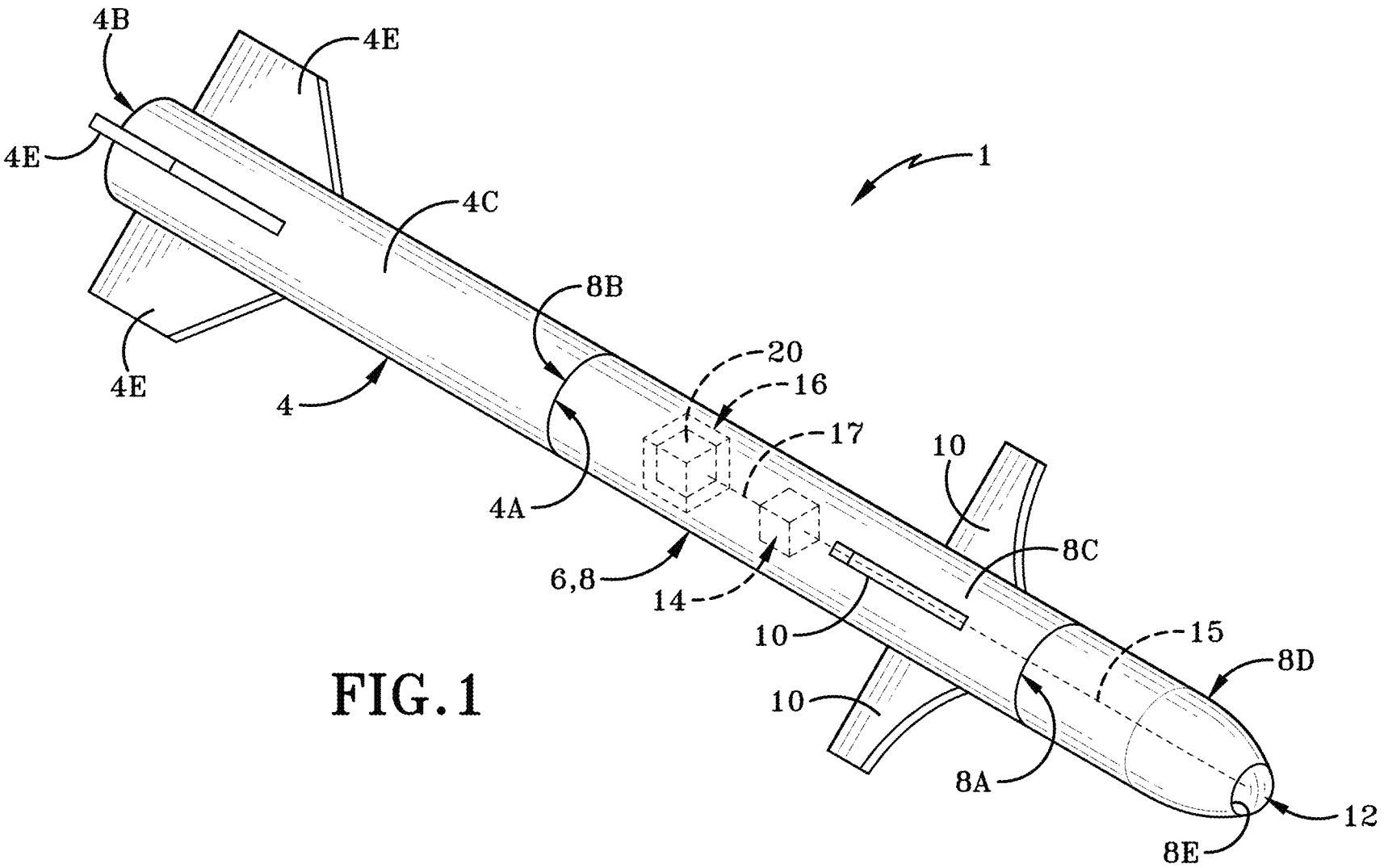
FIG. 1 illustrates a diagrammatic view of a ballistic device that includes a guidance kit in accordance with one aspect of the present disclosure.

FIG. 1 illustrates a projectile or ballistic device 1 that may be equipped with a guidance kit for guiding the illustrated projectile 1 to a specific target. As provided herein, the illustrated projectile 1 is a Hydra 70 rocket equipped a guidance kit for guiding the illustrated projectile 1 to a specific target. However, it should be understood that projectile 1 may be any type of moveable device regardless of whether it is a munition. For example, the projectile 1 could also be any manned or unmanned object that needs guidance in the manner discussed herein. Such use and purpose of the guidance kit with the illustrated projectile 1 is described in more detail below.

In the present disclosure, projectile 1 is configured to be launched from an aircraft or air-vehicle platform towards a desired airborne target for military operations (described in greater detail below. It will be understood that the platform discussed herein is exemplary only and any type of platform is contemplated to be represented. In one exemplary embodiment, the platform described herein may be represented as an aircraft or air vehicle (e.g., fixed-wing aircraft or rotary-wing aircraft that is manned or unmanned) that is capable of launching projectiles and other similar payloads from air and striking targets in air, on land, or at sea. In another exemplary embodiment, the platform described herein may be represented as hand-held launcher, a launcher fixed to a ground transporting vehicle, a launcher fixed to a naval vehicle, or other suitable launchers for launching projectiles and other similar devices from land or sea and striking targets on land or sea. In another exemplary embodiment, the platform described herein may be a ground launch vehicle that is operably engaged with a ground surface and is configured to launch surface-to-surface projectiles or missiles (or "SSM"), ground-to-ground projectiles or missiles (or "GGM"), or surface-to-air projectiles or missiles. Stated differently, the exemplary platform is capable of launching projectiles and other similar devices from land and striking targets in the air or on land or sea.

The projectile 1 may include a rocket motor or engine 4 configured to provide suitable propulsion and thrust needed for a desired military operation. The rocket motor 4 generally includes a first or front end 4A, a second or rear end 4B opposite to the first end 4A, and a longitudinal axis defined therebetween. The rocket motor 4 also generally includes a cylindrical wall 4C that extends between the first end 4A and the second end 4B along the longitudinal axis of the rocket motor 4. While not illustrated herein, suitable rocket propellants and elements may be stored inside of the cylindrical wall 4C (e.g., a chamber defined inside of the cylindrical wall 4C) that generate propulsion and thrust for the rocket motor 4. The rocket motor 4 also includes an aft fin member 4D operably engaged with the cylindrical wall 4C proximate to the second end 4B of the rocket motor 4. The aft fin member 4D may provide flight assistance to the projectile 1 at the second end 4B of the rocket motor 4 as the projectile 1 travels through the air between the initial launch at the platform 2 and a desired target.

In the illustrated embodiment, the rocket motor 4 of the projectile 1 may be a standard 2.75-inch rocket motor (e.g., liquid-fueled rocket motors, solid-fueled rocket motors, or other suitable rocket motors of the like). In other exemplary embodiments, any suitable rocket motor may be equipped for a projectile based on the mission and/or objective.

Projectile 1 also includes a feed forward guidance kit (hereinafter "guidance kit") generally referred to as 6 that is configured to guide the projectile 1 to a specific target. The guidance kit 6 may include legacy hardware and protocols that are configured to initiate and/or deploy on-board devices to guide and/or direct the projectile 1 to a specific target. The guidance kit 6 is also configured to operably engage a rocket motor, such as rocket motor 4, to enable guidance capabilities to the rocket motor. As described above, the guidance kit 6 provided with the projectile 1 is a legacy guidance kit and/or apparatus. In one example, the legacy guidance kit described and illustrated herein may be an Advanced Precision Kill Weapon System (APKWS) laser guidance kit manufactured by BAE Systems. In another example, the legacy guidance kit described and illustrated herein may be a preexisting or legacy guidance kit that includes commercially-available navigation equipment and/or instruments, including inertial navigation systems or inertial measurement units, for guiding and steering a projectile to a desired target.

Projectile 1 also includes a body 8 that operably engages with the rocket motor 4 and houses the guidance kit 6. The body 8 includes a first or front end 8A positioned away from the rocket motor 4, a second end 8B opposite to the first end 8A and operably engages with the rocket motor 4 at the first end 4A of the rocket motor 4, and a longitudinal axis defined therebetween. The body 8 also includes a cylindrical wall 8C that extends between the first end 8A and the second end 8B. The cylindrical wall 8C of the body 8 may also be configured to house devices and components of the guidance kit 6 and other guidance devices discussed in greater detail below. The body 8 may also include a fairing 8D that operably engages with the first end 8A of the body 8 wherein the fairing 8D is the foremost part of projectile 1. Fairing 8D may also define a fore or front opening 8E that extends longitudinally into fairing 8D for housing at least one optical imaging device of projectile 1, which is described in more detail below.

Projectile 1 may also include a set flaperons or wings 10 operably engaged with the body 8. As best seen in FIG. 1, each wing of the set of wings 10 is fixed and remains stationary with the body 8 such that each wing of the set of wings 10 are free from moving relative to the body 8. In one exemplary embodiment, each wing of the set of wings 10 may be moveable on the body 8 proximate to the first end 8A of the body 8. In this exemplary embodiment, the set of wings 10 may be pivotable outwardly from the body 8 when the projectile 1 is launched and travels through the air.

Guidance kit 6 may also include an optical imaging device 12. As best seen in FIG. 1, optical imaging device 12 operably engages with the fairing 8D inside of the fore opening 8E. In the present disclosure, a portion of the optical imaging device 12 is visible to the external environment and/or far field forward of the projectile 1. During operation, optical imaging device 12 is configured to visualize and detect one or more electromagnetic wavelengths (e.g., visible light or visible spectrum wavelengths, infrared wavelengths, ultraviolet wavelengths, etc.) of desired targets, particularly aircrafts and air vehicles in flight. In one instance, optical imaging device 12 may be an electro-optical/infrared-red ("EOIR") device for visualizing and detecting infrared wavelengths of heat sources or signatures of desired targets, particularly engines or engine exhaust plumes of aircrafts and air vehicles. As described in greater detail below, optical imaging device 12 is configured to detect and capture one or more electromagnetic wavelengths of at least one desired target to show the orientation of the at least one desired target during flight.

Projectile 1 also includes at least one processor 14 that is housed inside of a chamber of the body 8. In the present disclosure, a single processor 14 is illustrated herein for schematic and diagrammatic purposes. In other exemplary embodiments, any suitable number of processors may be provided with a projectile for specific a military operation (e.g., guidance protocols and methods). Processor 14 is configured to logically perform protocols and/or methods that the processor 14 has access to prior to military operation, including guidance protocols and methods used in an existing laser guidance kit. The processor 14 may also be powered by an on-board power source and/or power supply (e.g., portable battery, etc.) in order to logically perform protocols and/or methods that are operatively in communication with the processor 14. The processor 14 may also be in logical communication with a tangible medium, such as a computer readable medium, for executing conventional guidance applications or protocols and/or novel guidance applications or protocols discussed herein.

In the present disclosure, the processor 14 is operatively connected with the optical imaging device 12 via an electrical connection such as wire or other similar electrical connection of the like. As best seen in FIG. 1, the processor 14 is operatively connected with optical imaging device 12 via a first electrical connection 15. With such electrical connection, via the first electrical connection 15, the optical imaging device 12 and the processor 14 are enabled to communicate with one another during a military operation. Particularly, optical imaging device 12 may send and/or output one or more images of a desired target detected and captured by the optical imaging device 12 during a military operation. As discussed in greater detail below, processor 14 utilizes the one or more images of the desired target, as captured by the optical imaging device 12, in combination with a feed forward guidance protocol to proactively estimate and/or calculate an anticipated second position of a desired target during a military operation.

Guidance kit 6 also includes at least one non-transitory computer readable medium 16 that is housed inside of the chamber of the body 8. In the present disclosure, a single computer readable medium 16 is illustrated herein for schematic and diagrammatic purposes. In other exemplary embodiments, any suitable number of computer readable media may be provided with a projectile for specific a military operation (e.g., guidance protocols and methods). Computer readable medium 16 is configured to logically store protocols and/or methods that the processor 14 has access to prior to military operation, including guidance protocols and methods used in an existing laser guidance kit. Computer readable medium 16 may also be powered by an on-board power source and/or power supply (e.g., portable battery, etc.) in order to be operatively in communication with the processor 14.

In the present disclosure, the computer readable medium 16 is operatively connected with the processor 14 via an electrical connection such as wire or other similar electrical connection of the like. As best seen in FIG. 1, the computer readable medium 16 is operatively connected with processor 14 via a second electrical connection 17. With such electrical connection, via the second electrical connection 17, the processor 14 and the computer readable medium 16 are enabled to communicate with one another during a military operation. As discussed in greater detail below, processor 14 may access and execute a feed forward guidance protocol stored in the computer readable medium 16 to proactively estimate and/or calculate an anticipated second position of a desired target during a military operation.

Figure 2:
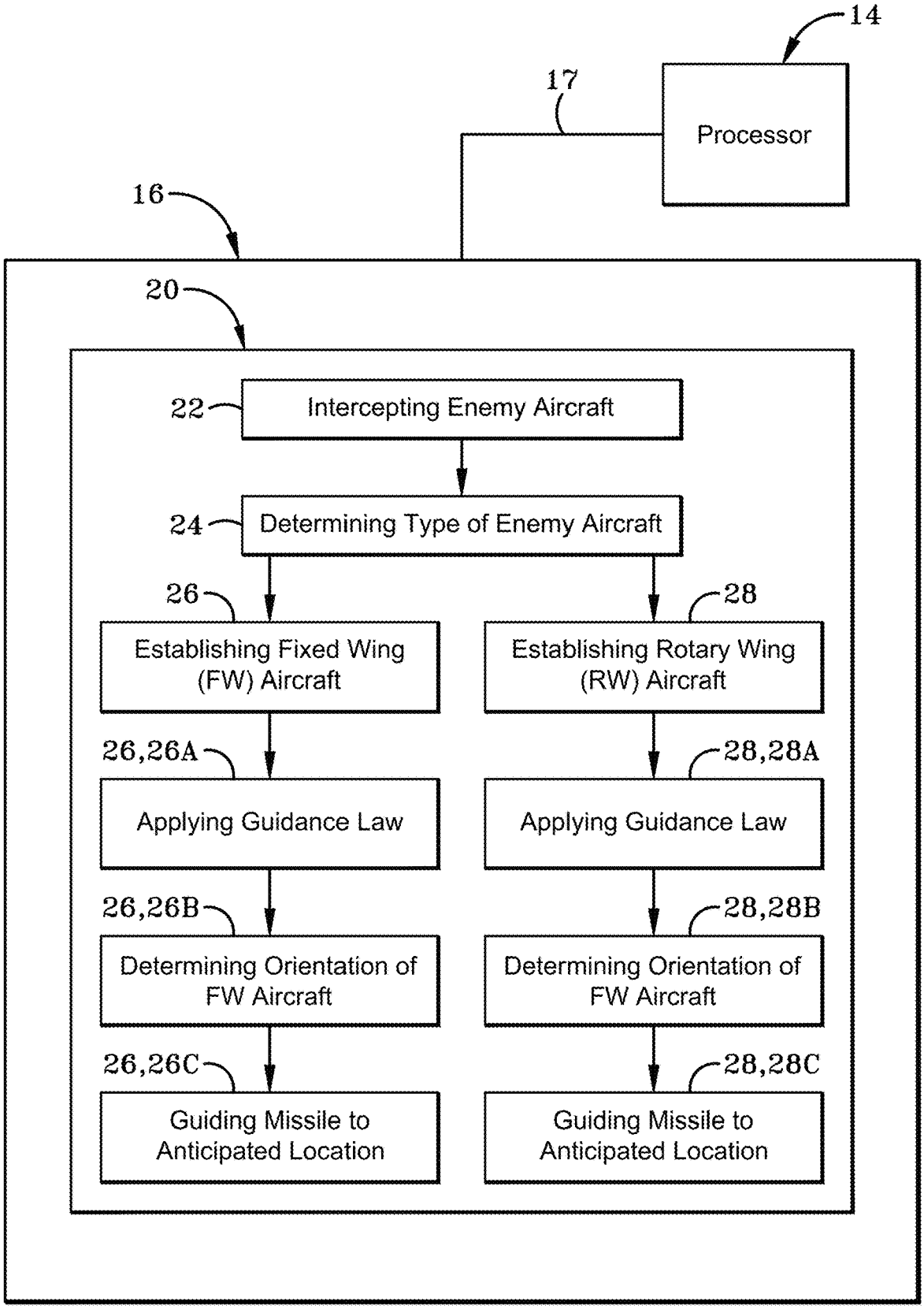
FIG. 2 illustrates a diagrammatic flowchart of a feed forward guidance application of the guidance kit in accordance with one aspect of the present disclosure.

Guidance kit 6 also includes a feed forward guidance application and/or protocol 20 (hereinafter "feed forward guidance protocol 20"). As best seen in FIG. 2, the feed forward guidance protocol 20 is operatively connected with and/or in logical communication with processor 14. In the present disclosure, feed forward guidance protocol 20 may be loaded into a tangible medium, such as computer readable medium 16, that is in logical communication with the processor 14 for executing and running the feed forward guidance protocol 20 during a military operation. As discussed in greater detail below, feed forward guidance protocol 20 is configured to allow a guidance kit 6 of projectile 1 to proactively guide and/or direct the projectile 1 to an anticipated second position of a desired target during a military operation. Such functions and sets of instructions of the feed forward guidance protocol 20 are discussed in greater detail below.

Feed forward guidance protocol 20 includes an initial and/or intercepting function 22. As best seen in FIG. 2, intercepting function 22 is initiated once optical imaging device 12 is powered to an operating state and begins viewing and capturing the far field for one or more desired targets in flight (as denoted by a dashed lines labeled 12A in FIGS. 3A-3E and 4A-4E showing such field of view of the optical imaging device 12). The intercepting function 22 of feed forward guidance protocol 20 is continuously executed by processor 14 until the optical imaging device 12 outputs at least one image capturing one or more desired targets to the processor 14. Upon such capturing, the processor 14 may then continue using the feed forward guidance protocol 20.

Feed forward guidance protocol 20 also includes an identifier function 24. As best seen in FIG. 2, identifier function 24 is in logical communication with the intercepting function 22 such that the identifier function 24 is in series with the intercepting function 22 and is executed by the processor 14 subsequent to the intercepting function 22.

During operation, the identifier function 24 is initiated by processor 14 subsequent to initiating the intercepting function 22 (i.e., when optical imaging device 12 detects and captures one or more desired targets in the far field). Here, identifier function 24 is configured to identify and/or classify the type of aircraft in which the optical imaging device 12 detected and captured in the far field. Stated differently, identifier function 24 is configured to identify and/or classify whether an aircraft detected and captured in the far field by the optical imaging device 12 is a fixed-wing aircraft (manned or unmanned) or a rotary-wing aircraft (manned or unmanned). Such identification executed by the processor 14 may be based on various parameters pre-loaded into the identifier function 24 of feed forward guidance protocol 20, including generic outlines and/or shapes of fixed-wing aircrafts (manned or unmanned) and rotary-wing aircrafts (manned or unmanned), propulsion and/or drive systems provided on the aircraft (e.g., one or more rotors, turbines, etc.), and other various attributes and identifiers for identifying the type of aircraft. In practice, the identifier function 24 instructs the processor 14 to identify the type of aircraft by matching a rough shape estimate of the type of aircraft provided by and accessible with identifier function 24. As described in greater detail below, such outline and/or shape estimation of the type of aircraft may also be utilized for estimating the orientation of the aircraft at later functions or steps of the feed forward guidance protocol 20.

Feed forward guidance protocol 20 also includes a first set of instructions 26 and a second set of instructions 28. As best seen in FIG. 2, each of the first set of instructions 26 and the second set of instructions 28 is in logical communication with the identifier function 24 wherein each of the first set of instructions 26 and the second set of instructions 28 is in series with the intercepting function 22. During operation, one of the first set of instructions 26 and the second set of instructions 28 is initiated by processor 14 subsequent to initiating the identifier function 24 (i.e., identifying the type of aircraft viewed and captured by optical imaging device 12). In one instance, processor 14 may execute and run the first set of instructions 26 when the identifier function 24 identifies the aircraft, captured by optical imaging device 12, as a first or fixed-wing aircraft. In another instance, processor 14 may execute and run the second set of instructions 28 when the identifier function 24 identifies the aircraft, captured by optical imaging device 12, as a second or rotary-wing aircraft. Such functions and/or steps of each of the first set of instructions 26 and the second set of instructions 28 by processor 14 is discussed in greater detail below.

With respect to the first set of instructions 26, first set of instructions 26 includes a first guidance law function 26A. As best seen in FIG. 2, the first guidance law function 26A is in logical communication with the identifier function 24 wherein the first guidance law function 26A is in series with the identifier function 24 and is executed by the processor 14 subsequent to the identifier function 24.

In operation, the first guidance law function 26A is configured to enable the processor 14 to utilize a guidance law or a set of guidance laws based on the features and/or attributes identified by the identifier function 24. In this instance, the processor 14 would utilize a guidance law or set of guidance laws (e.g., proportional navigation or Pro-Nav) pertaining to fixed-wing aircrafts that is pre-loaded into the first guidance law function 26A. Such guidance law and/or set of guidance laws pertaining specifically to fixed-wing aircrafts provides the processor 14 with the capability of understanding generic and/or known flight capabilities of fixed-wing aircrafts, including normal and/or known maneuver capabilities performed by fixed-wing aircrafts and the acceleration of the fixed-wing aircrafts prior to generating a position change (i.e., generating a body angle of attack).

The first set of instructions 26 also includes a first orientation function 26B. As best seen in FIG. 2, the first orientation function 26B is in logical communication with the first guidance law function 26A such that the first orientation function 26B is in series with the first guidance law function 26A and is executed by the processor 14 subsequent to the first guidance law function 26A. In one exemplary embodiment, the first orientation function 26B may be executed by the processor 14 simultaneously or concurrently with the first guidance law function 26A.

In operation, the first orientation function 26B is configured to enable the processor 14 to determine and/or identify the orientation of the fixed-wing aircraft based on the one or more images captured and outputted by the optical imaging device 12 and the rough outline and/or shape identified by the identifier function 24. In one example, the first orientation function 26B instructs the processor 14 to calculate a first orientation output when the optical imaging device 12 sends one or more images showing the fixed-wing aircraft translating from an initial orientation traveling in a first direction to a first translated orientation traveling in a second direction different than the first direction. Stated differently, the first orientation function 26B instructs the processor 14 to calculate a first orientation output when the optical imaging device 12 sends one or more images showing the fixed-wing aircraft banking and/or turning from an initial orientation traveling in a first direction to a first translated orientation traveling in a second direction different than the first direction. Such calculation of the translated orientation of the fixed-wing aircraft provides desired data and information for calculating the anticipated and/or estimated position of the fixed-wing aircraft.

The first set of instructions 26 also includes a first guidance function 26C. As best seen in FIG. 2, the first guidance function 26C is in logical communication with the first orientation function 26B such that the first guidance function 26C is in series with the first orientation function 26B and is executed by the processor 14 subsequent to the first orientation function 26B. In one exemplary embodiment, the first guidance function 26C may be executed by the processor 14 simultaneously or concurrently with the first guidance law function 26A and the first orientation function 26B.

In operation, the first guidance function 26C is configured to enable the processor 14 to calculate the anticipated second position ahead of the desired target based on the information provided by the first guidance law function 26A and the first orientation function 26B. Particularly, the first guidance function 26C is configured to enable the processor to calculate the anticipated second position that is ahead of the desired target based on the guidance law and/or set of guidance laws for fixed-wing aircrafts, provided by the first guidance law function 26A, and the calculated orientation of the fixed-wing aircraft, provided by the first orientation function 26B, measured from the one or more images captured by optical imaging device 12. Such calculation of the anticipated second position by the processor 14 thus enables the guidance kit 6 to guide the projectile 1 to the anticipated second position of the fixed-wing aircraft when measured from the first translated orientation.

With respect to the second set of instructions 28, second set of instructions 28 includes a second guidance law function 28A. As best seen in FIG. 2, the second guidance law function 28A is in logical communication with the identifier function 24 such that the second guidance law function 28A is in series with the identifier function 24 and is executed by the processor 14 subsequent to the identifier function 24.

In operation, the second guidance law function 28A is configured to enable the processor 14 to utilize a guidance law or a set of guidance laws based on the features and/or attributes identified by the identifier function 24. In this instance, the processor 14 would utilize a guidance law or set of guidance laws (such as proportional navigation or Pro-Nav) pertaining to rotary-wing aircrafts that is preloaded into the second guidance law function 28A. Such guidance law and/or set of guidance laws pertaining specifically to rotary-wing aircrafts provides the processor 14 with the capability of understanding generic and/or known flight capabilities of rotary-wing aircrafts, including normal and/or known maneuver capabilities performed by rotary-wing aircrafts and the acceleration of the rotary-wing aircrafts prior to generating a position change (i.e., generating a body angle of attack).

The second set of instructions 28 also includes a second orientation function 28B. As best seen in FIG. 2, the second orientation function 28B is in logical communication with the second guidance law function 28A such that the second orientation function 28B is in series with the second guidance law function 28A and is executed by the processor 14 subsequent to the second guidance law function 28A. In one exemplary embodiment, the second orientation function 28B may be executed by the processor 14 simultaneously or concurrently with the second guidance law function 28A.

In operation, the second orientation function 28B is configured to enable the processor 14 to determine and/or identify the orientation of the rotary-wing aircraft based on the one or more images captured and outputted by the optical imaging device 12 and the rough outline and/or shape identified by the identifier function 24. In one example, the second orientation function 28B instructs the processor 14 to calculate a first orientation output when the optical imaging device 12 sends one or more images showing the rotary-wing aircraft translating from an initial orientation traveling in a first direction to a first translated orientation traveling in a second direction different than the first direction. Stated differently, the second orientation function 28B instructs the processor 14 to calculate a first orientation output when the optical imaging device 12 sends one or more images showing the rotary-wing aircraft banking and/or turning from an initial orientation traveling in a first direction to a first translated orientation traveling in a second direction different than the first direction. Such calculation of the translated orientation of the rotary-wing aircraft provides desired data and information for calculating the anticipated and/or estimated position of the rotary-wing aircraft.

The second set of instructions 28 also includes a second guidance function 28C. As best seen in FIG. 2, the second guidance function 28C is in logical communication with the second orientation function 28B such that the second guidance function 28C is in series with the second orientation function 28B and is executed by the processor 14 subsequent to the second orientation function 28B. In one exemplary embodiment, the second guidance function 28C may be executed by the processor 14 simultaneously or concurrently with the second guidance law function 28A and the second orientation function 28B.

In operation, the second guidance function 28C is configured to enable the processor 14 to calculate the anticipated second position based on the information provided by the second guidance law function 28A and the second orientation function 28B. Particularly, the second guidance function 28C is configured to enable the processor to calculate the anticipated second position based on the guidance law and/or set of guidance laws for rotary-wing aircrafts, provided by the second guidance law function 28A, and the calculated orientation of the rotary-wing aircraft, provided by the second orientation function 28B, measured from the one or more images captured by optical imaging device 12. Such calculation of the anticipated second position by the processor 14 thus enables the guidance kit 6 to guide the projectile 1 to the anticipated second position ahead of the rotary-wing aircraft when measured from the initial orientation to the first translated orientation.

The feed forward guidance protocol 20 is considered advantageous at least because the feed forward guidance protocol 20 enables the guidance kit 6 to proactively estimate the anticipated location of the desired target ahead of the desired target once the enemy maneuvers and/or banks from an initial position to a first orientation captured by the guidance kit 6. As such, the feed forward guidance protocol 20 enables the guidance kit 6 to guide the projectile 1 to the anticipated location of the desired target without having the guidance kit 6 continuously monitoring and measuring the orientation and speed of the desired target as compared to conventional, reactive navigation protocols. By removing these reactive parameters, the feed forward guidance protocol 20 reduces the peak acceleration and/or speed for the projectile 1 to reach the desired target (when within one-half of a kilometer of the desired target to within two kilometers of the desired target) depending on the sensor parameters of the optical imaging device 12 and the desired target's dimensions.

Moreover, feed forward guidance protocol 20 is considered advantageous at least because the feed forward guidance protocol 20 provided with the guidance kit 6 increases the effectiveness of intercepting the desired target (either fixed-wing aircrafts or rotary-wing aircrafts) and reduces the requirements of the rocket motor and the payload/warhead. The increase of effectiveness in intercepting the desired target is also performed with legacy and/or preexisting hardware of the guidance kit 6 as well as other devices and/or components previously installed on the projectile 1.

Having now described the feed forward guidance protocol 20, a method of executing the feed forward guidance protocol 20 for proactively calculating and guiding the projectile 1 to an estimated and/or anticipated second position of a desired target is discussed in greater detail below.

During a military operation, a friendly aircraft or platform 30 loaded with one or more projectiles 1, as described and illustrated herein, may be in combat with an enemy aircraft or platform 32. In the present disclosure, the friendly aircraft 30 is moving in a first direction (denoted by an arrow labeled 30A) similar to a first direction (denoted by an arrow labeled 32A) of the enemy aircraft 32. Once engaged with the enemy aircraft 32, the friendly aircraft 30 may fire a first projectile 1 towards the enemy aircraft 32 in a first direction (denoted by an arrow labeled 34A) for eliminating or neutralizing the enemy aircraft 32 as a threat (see FIGS. 3A and 4A). It should be understood that the distance between the friendly aircraft 30 and the enemy aircraft 32 is shown diagrammatically for illustrative purposes and should not limit the use of projectile 1 described and illustrated herein.

Once the projectile 1 is launched from the friendly aircraft 30, the guidance kit 6 of projectile 1 is initiated to guide to projectile 1 towards the enemy aircraft 32 with assistance from the feed forward guidance protocol 20. As best seen in FIGS. 3A-4A, the optical imaging device 12 of guidance kit 6 is initiated to an operating state for detecting and capturing the enemy aircraft 32 in the far field. Once in the operating state, the optical imaging device 12 is then configured to view and capture an estimated outline and/or shape of the enemy aircraft 32 when launched and in flight towards the enemy aircraft 32. As best seen in FIGS. 3B-4B, the optical imaging device 12 views the far field at a viewing angle (denoted by dashed lines labeled 12A) in order to detect and capture an estimated outline and/or shape of the enemy aircraft 32 in the far field. During flight, the optical imaging device 12 may send or output one or more images capturing a rough or estimated outline or shape of the enemy aircraft 32 for guidance purposes, which is discussed in greater detail below. During flight, the optical imaging device 12 may also continuously send or output more than one image capturing a rough or estimated outline or shape of the enemy aircraft 32 between an initial position or location of the enemy aircraft 32 to a first translated position or location of the enemy aircraft 32.

Once the optical imaging device 12 is provided in the operating state, the guidance kit 6 may simultaneously or concurrently power the processor 14 and the computer readable medium 16 to an operating state for utilizing the feed forward guidance protocol 20. As stated above, the processor 14 may execute the feed forward guidance protocol 20 stored in the computer readable storage medium 16 of the guidance kit 6. Once executed, the processor 14 may initially execute the intercepting function 22 as the optical imaging device 12 is initiated to the operating state for detecting and capturing the enemy aircraft 32 in the far field (see FIG. 2). The data and images outputted from the optical imaging device 12 are sent to the processor 14 to confirm that the optical imaging device 12 has intercepted a desired target (i.e., enemy aircraft 32) at a first or initial position and orientation.

Upon such interception of enemy aircraft 32, the processor 14 may then execute the identifier function 24 to enable the processor 14 to determine what type of aircraft the enemy aircraft 32 is during flight (see FIG. 2). Once executed, the processor 14 may then use the data and information pre-loaded into the identifier function 24 to determine the type of aircraft the enemy aircraft 32 is based on the one or more images captured by the optical imaging device 12. As explained above, the processor 14 may analyze the rough or estimated outline and/or shape of the enemy aircraft 32 captured in the one or more images outputted by the optical imaging device 12 with the preloaded data and information provided in the identifier function 24. In this example, the processor 14 would determine that the enemy aircraft 32 is a fixed-wing aircraft based on a comparison the rough or estimated outline and/or shape of the enemy aircraft 32 captured in the one or more images outputted by the optical imaging device 12 and the preloaded data and information for fixed-wing aircrafts provided in the identifier function 24. Upon such determination, the processor 14 would then execute the first set of instructions 26 due to the first set of instructions 26 being optimized for fixed-wing aircrafts.

Upon execution of the first set of instructions 26, the processor 14 may then execute the first guidance law function 26A. Such execution by the processor 14 instructs the processor 14 to access and load in a guidance law or a set of guidance laws pertaining to fixed-wing aircrafts, like enemy aircraft 32. Such access to the guidance law or the set of guidance laws provides the processor 14 with the capability of understanding generic and/or known flight capabilities of fixed-wing aircrafts, including normal and/or known maneuver capabilities performed by fixed-wing aircrafts and the acceleration of the fixed-wing aircrafts prior to generating a position change. As described in greater detail below, the processor 14 relies upon this information when analyzing and calculating the orientation of the enemy aircraft 32 and the guidance of the projectile 1 towards an anticipated location of the enemy aircraft 32.

Upon execution of the first set of instructions 26, the processor 14 may also execute the first orientation function 26B. In the present disclosure, the processor 14 executes the first orientation function 26B in series with the first guidance law function 26A wherein the processor 14 executes the first orientation function 26B subsequent to the first guidance law function 26A. In one exemplary embodiment, the processor 14 may also execute the first orientation function 26B prior to or simultaneously or concurrently with the first guidance law function 26A.

Figure 3A:
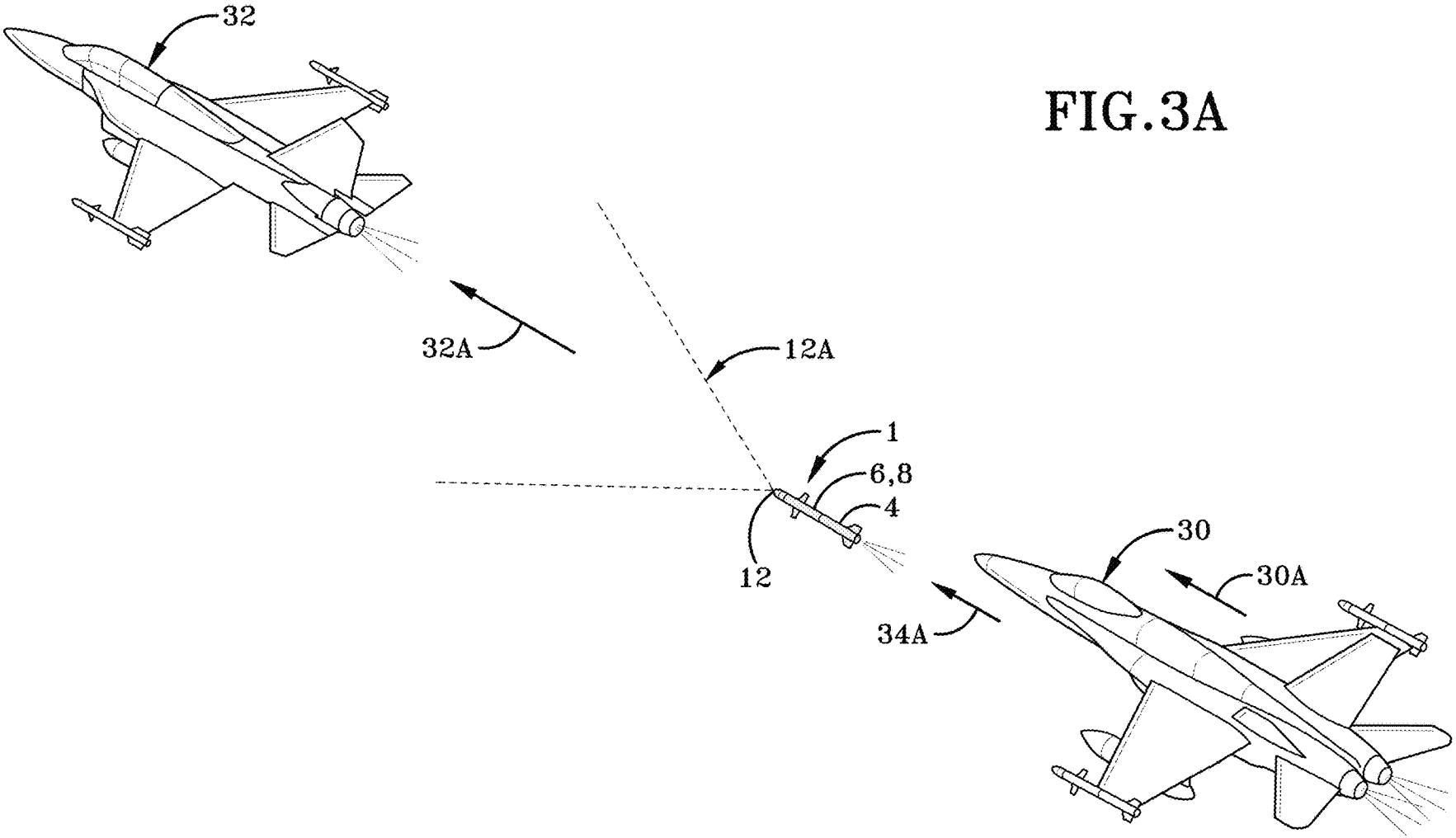
FIG. 3A illustrates an operational view of the ballistic device being launched from a platform and detecting an orientation of an desired target with the guidance kit of the ballistic device.
Figure 3B:
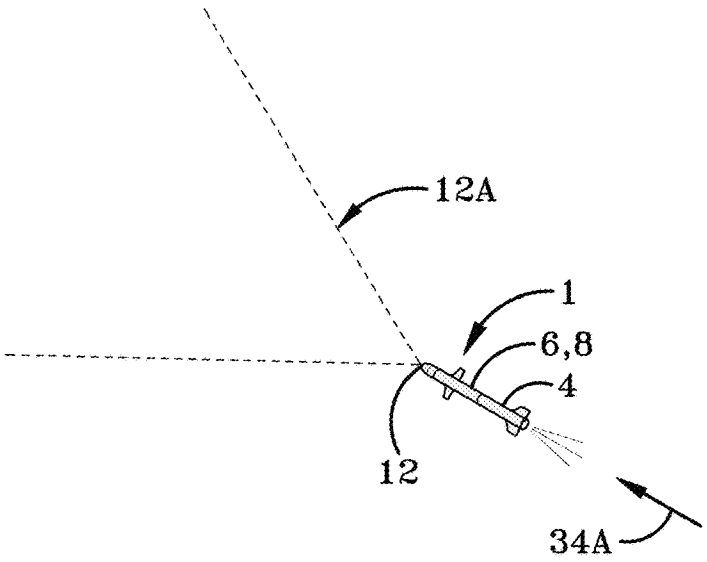
FIG. 3B illustrates another operational view similar to FIG. 3A, but an optical imaging device of the ballistic device identifies the desired target in flight.
Figure 3B:
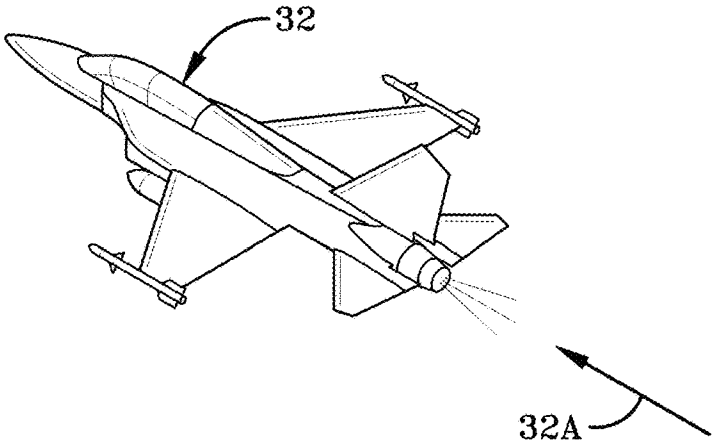
Figure 3C:
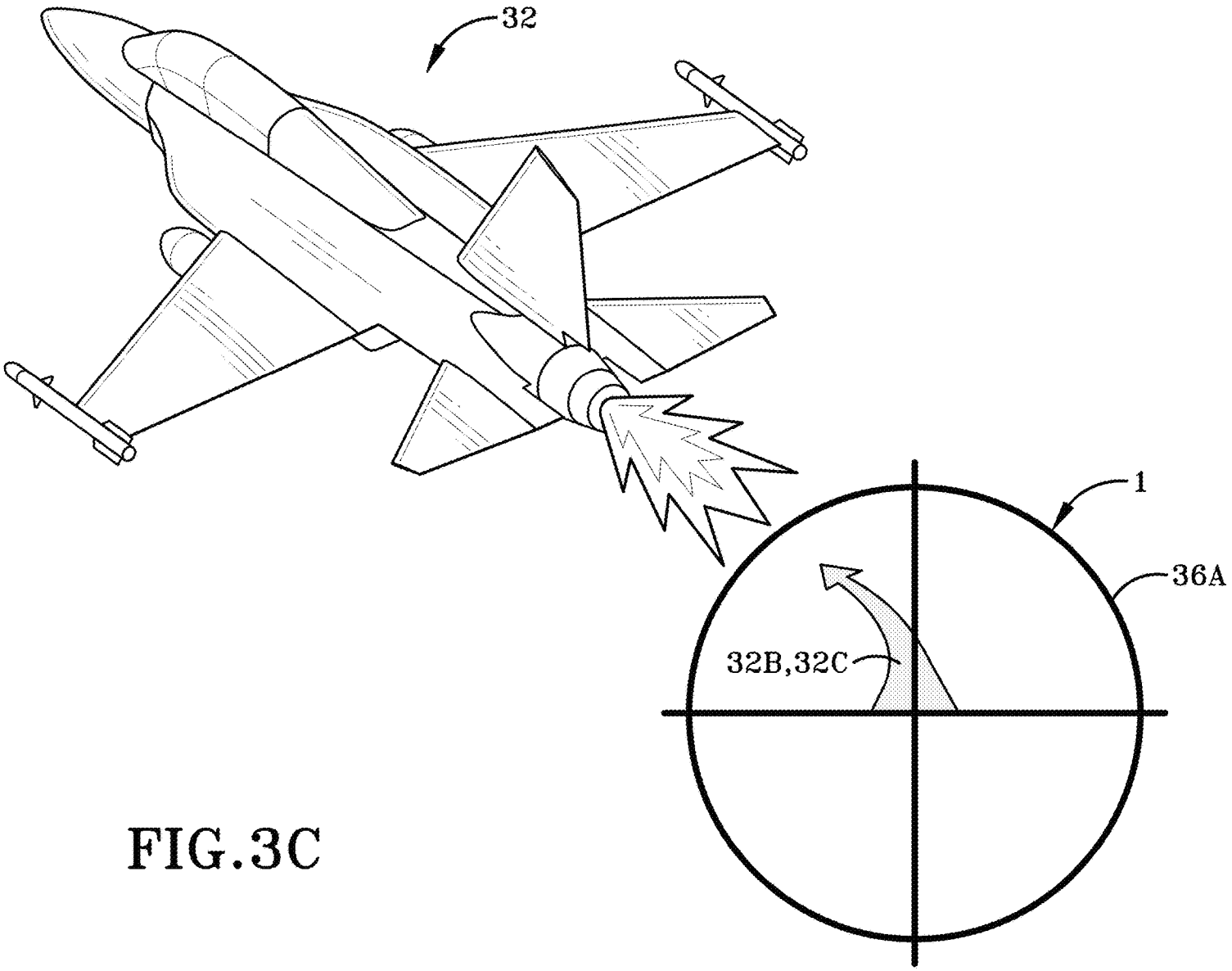
FIG. 3C illustrates another operational view similar to FIG. 3B, but the optical imaging device of the ballistic device identifies the desired target at an initial aim position as the desired target moves in a first direction.

Upon execution of the first orientation function 26B, the processor 14 is enabled to continuously analyze and detect orientation change of the enemy aircraft 32 until the enemy aircraft 32 maneuvers from an initial position with an initial orientation to a first translated position with a first translated orientation. As best seen in FIG. 3C, the optical imaging device 12 may detect and capture the enemy aircraft 32 maneuvering from the initial position in the first direction 32A having the initial orientation (FIGS. 3B and 4B) to the first translated position in a second direction 32B having the first translated orientation (FIGS. 3C-3E and 4C-4E). Once the optical imaging device 12 captures this transition of the enemy aircraft 32, the processor 14 may then utilize this change in orientation of the enemy aircraft in calculating the second translated or anticipated second position of the enemy aircraft 32.

Upon analyzing the change of orientation and direction of the enemy aircraft 32, the processor 14 may then execute the first guidance function 26C. As discussed previously, the first guidance function 26C is configured to enable the processor 14 to calculate the anticipated second position based on the information provided by the first guidance law function 26A and the first orientation function 26B. Particularly, the first guidance function 26C is configured to enable the processor 14 to calculate the anticipated second position based on the guidance law and/or set of guidance laws for fixed-wing aircrafts, provided by the first guidance law function 26A, and the change of orientation of the fixed-wing aircraft, provided by the first orientation function 26B, measured from the one or more images captured by optical imaging device 12. Such calculation of the anticipated second position by the processor 14 thus enables the guidance kit 6 to guide the projectile 1 to the anticipated second position of the fixed-wing aircraft when measuring from the initial orientation to the first translated orientation.

Once the anticipated second position and/or second translated position of the enemy aircraft 32 is calculated, the processor 14 may then output the calculated anticipated second position to remaining guidance components and devices of guidance kit 6 for directing and guiding the projectile 1 to the anticipated second position. As best seen in FIGS. 3C-3D and 4C-4D, guidance kit 6 proactively guides and directs the projectile 1 from an initial aim position (denoted by a crosshair symbol labeled 36A) towards the anticipated aim position (denoted by a crosshair symbol labeled 36B) in a second direction (denoted by arrow labeled 34B), which is forward and/or ahead of an estimated flight path calculated by the guidance law or set of guidance laws pre-loaded into the feed forward guidance protocol 20 and the change of orientation of enemy aircraft 32 (e.g., a fixed-wing aircraft). It should be understood that the guidance kit 6 is free from further reacting to the change in orientation and the change in acceleration of the enemy aircraft 32 once the anticipated second position of the enemy aircraft 32 is determined by processor 14 upon executing the feed forward guidance protocol 20. Such omission by the guidance kit 6 of further reacting to the change in orientation and acceleration of the enemy aircraft 32 enables the projectile 1 to be guided along a shorter and straighter flight path in comparison to conventional projectiles utilizing feed backwards and/or reactive protocols for guiding projectiles.

Figure 3D:
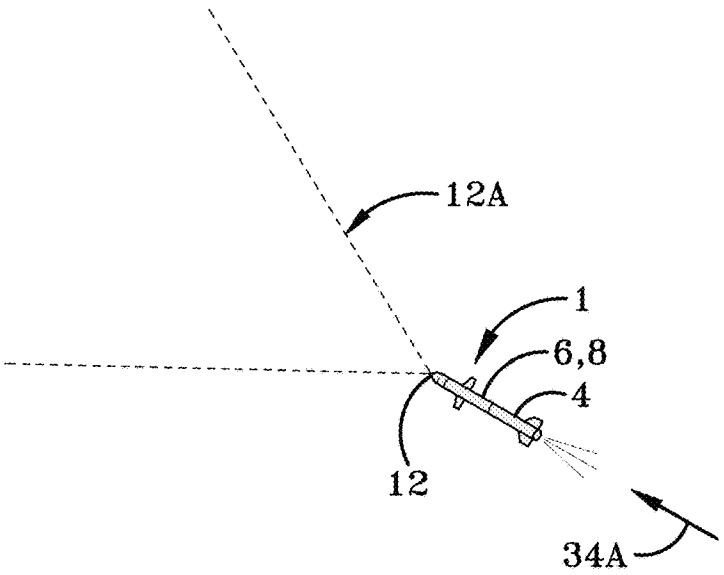
FIG. 3D illustrates another operational view similar to FIG. 3C, but the desired target maneuvers from the initial position to a first translated position in a second direction and to a second translated position in a third direction.
Figure 3D:
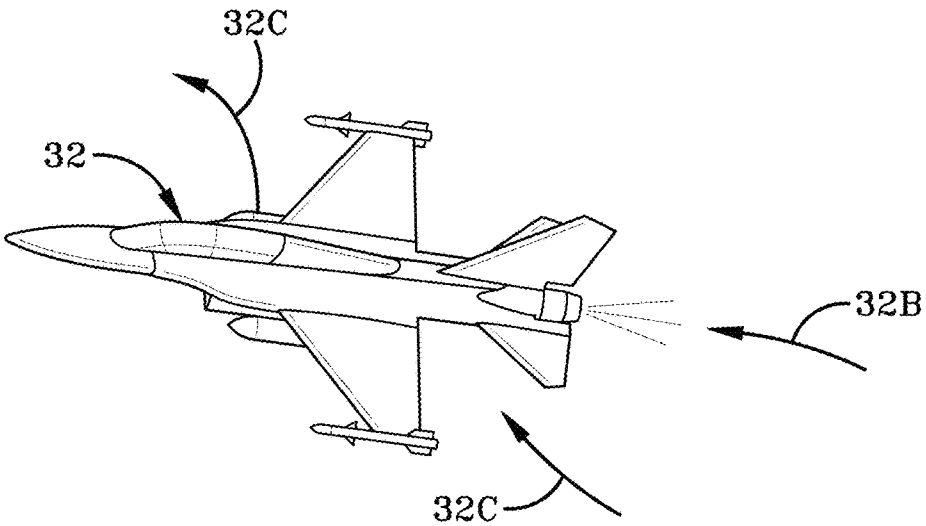
Figure 3E:
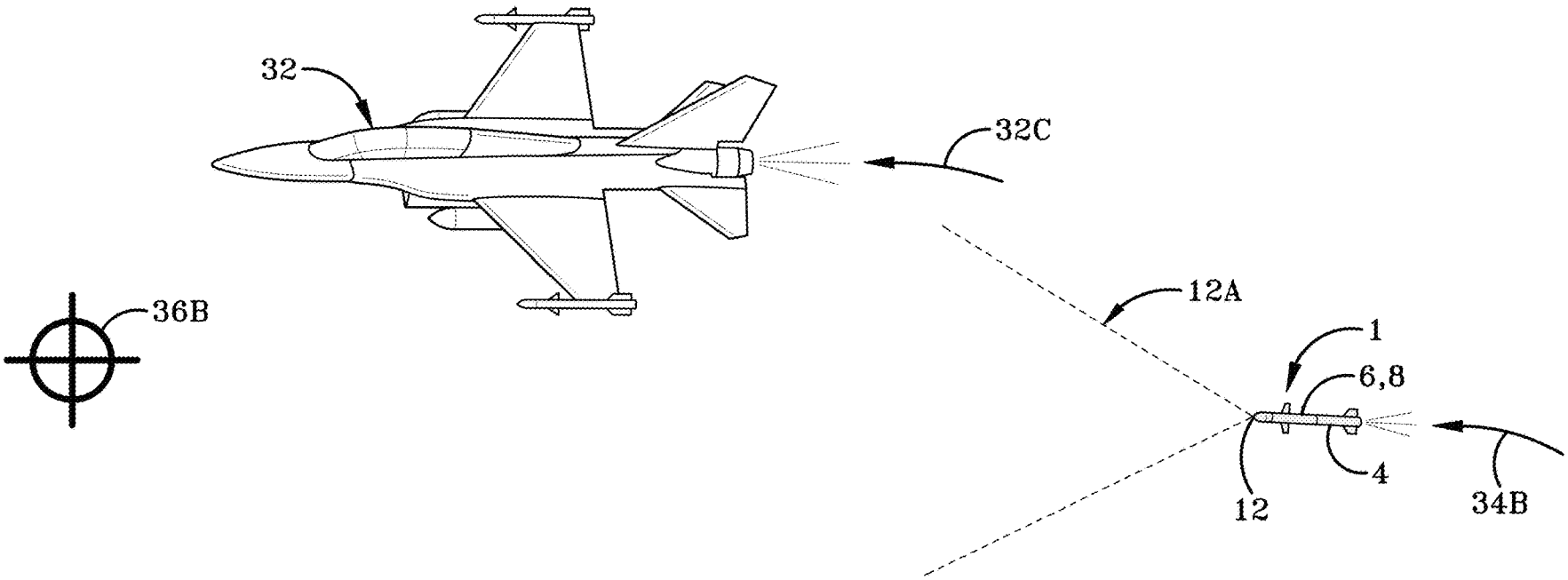
FIG. 3E illustrates another operational view similar to FIG. 3D, but the ballistic device anticipates a second aim position upon detecting a change in orientation of the desired target.
Figure 3F:
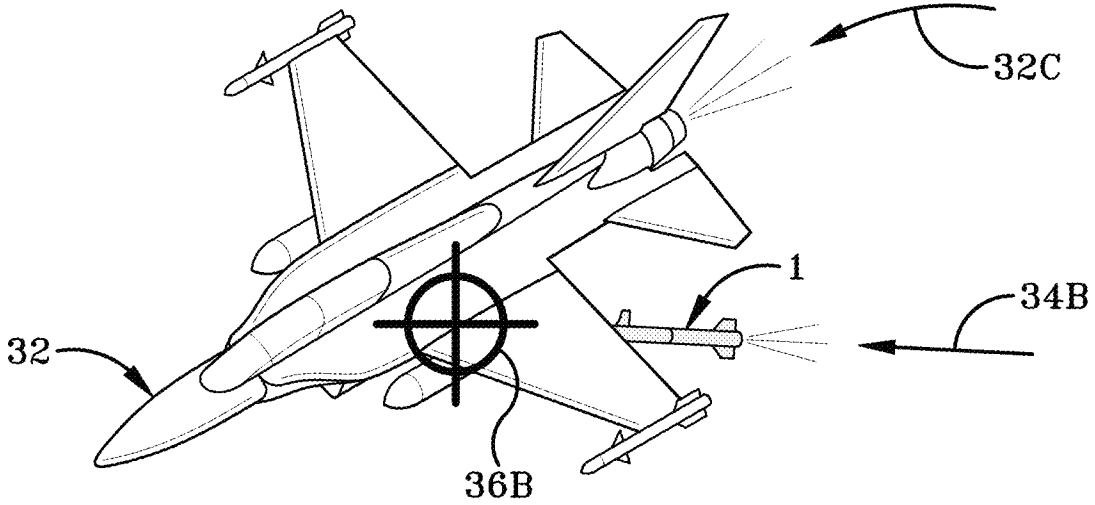
FIG. 3F illustrates another operational view similar to FIG. 3E, but the ballistic device strikes the desired target at an anticipated second position as the desired target moves in the third direction from the first translated position to the second translated position or the estimated position.

As the projectile 1 continues towards the anticipated aim position 36B, the enemy aircraft 32 may, in one instance, maneuver in a third direction 32C from a first translated position having the first translated orientation to a second translated position having a second translated orientation (see FIGS. 3D-3F). As best seen in FIGS. 3D-3F, the enemy aircraft 32 is banking upwardly from the first translated position having the first translated orientation to the second translated position having the second translated orientation in order to evade the projectile 1. However, since the feed forward guidance protocol 20 is pre-loaded with such guidance laws and maneuvering tactics, the anticipated second position 34 calculated by the processor 14 with assistance from the feed forward guidance protocol 20 provides a strike on the enemy aircraft 32 with projectile 1.

Figure 4A:
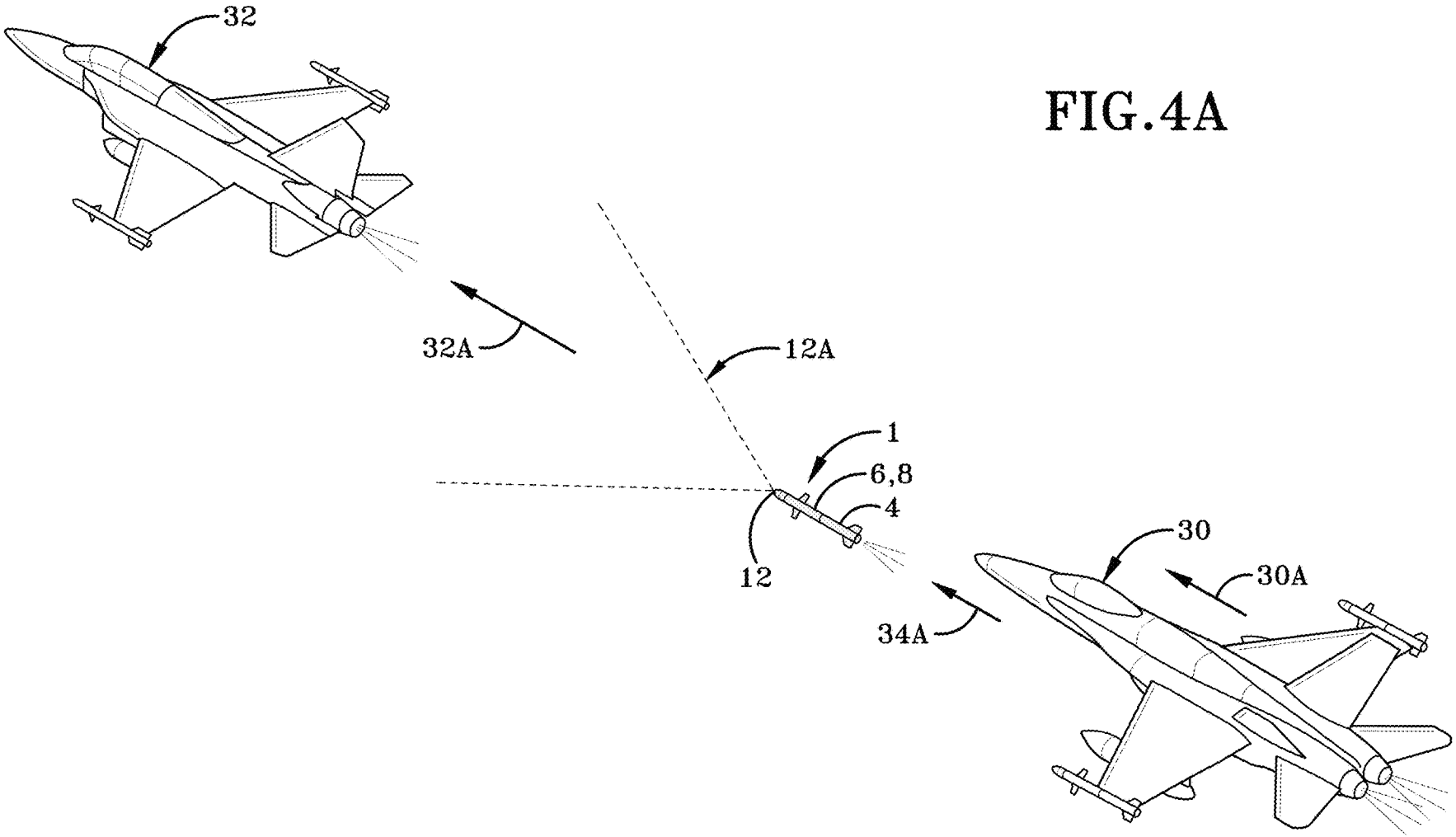
FIG. 4A illustrates an operational view of the ballistic device being launched from a platform and detecting an orientation of an desired target with the guidance kit of the ballistic device.
Figure 4B:
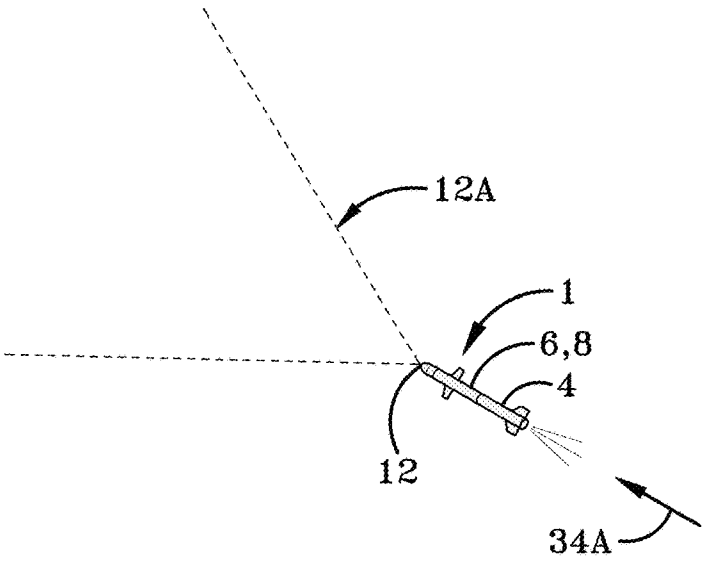
FIG. 4B illustrates another operational view similar to FIG. 4A, but an optical imaging device of the ballistic device identifies the desired target in flight.
Figure 4B:
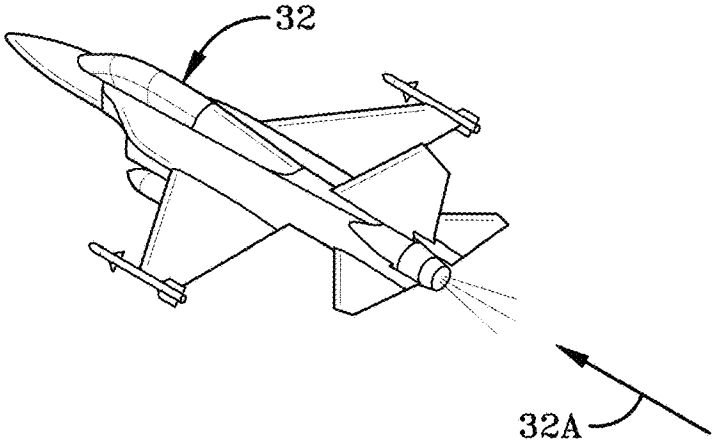
Figure 4C:
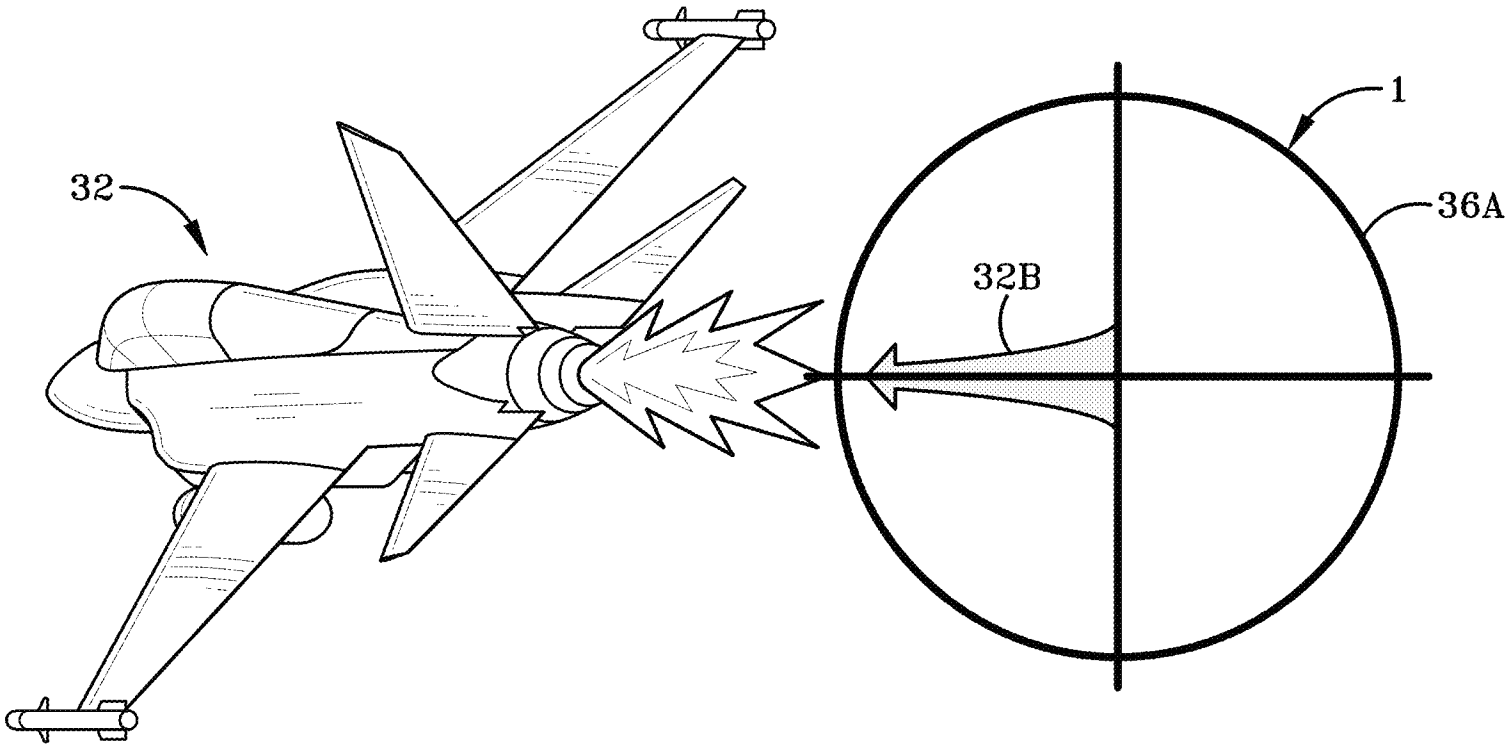
FIG. 4C illustrates another operational view similar to FIG. 4B, but the optical imaging device of the ballistic device identifies the desired target at an initial aim position as the desired target moves in a first direction.
Figure 4D:
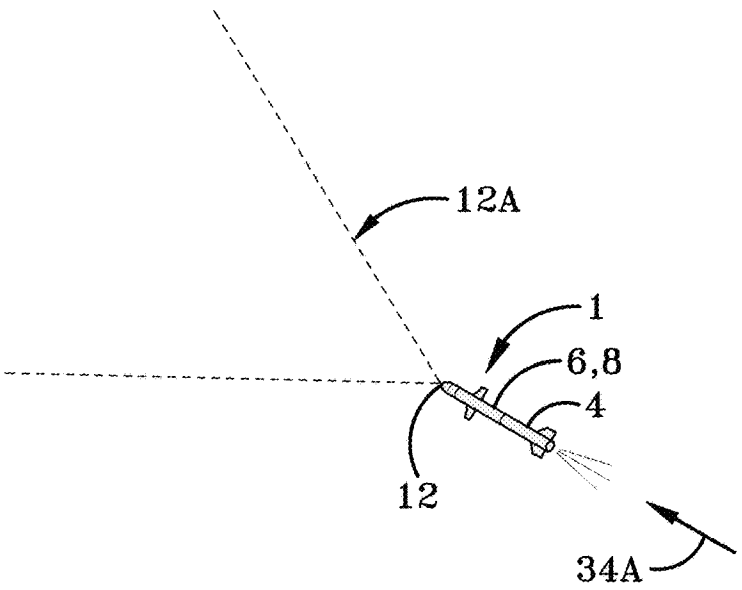
FIG. 4D illustrates another operational view similar to FIG. 4C, but the desired target maneuvers from the initial position to a first translated position in a second direction.
Figure 4D:
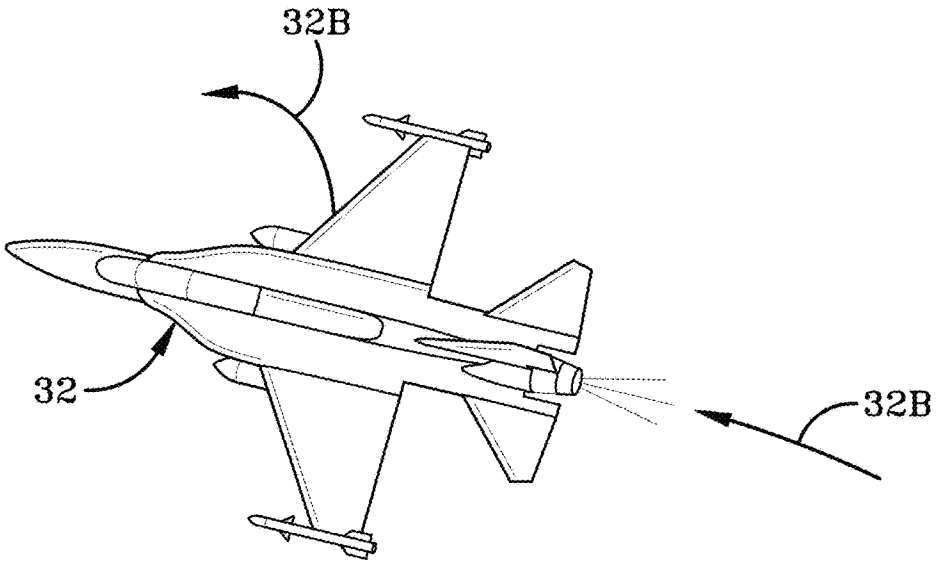
Figure 4E:
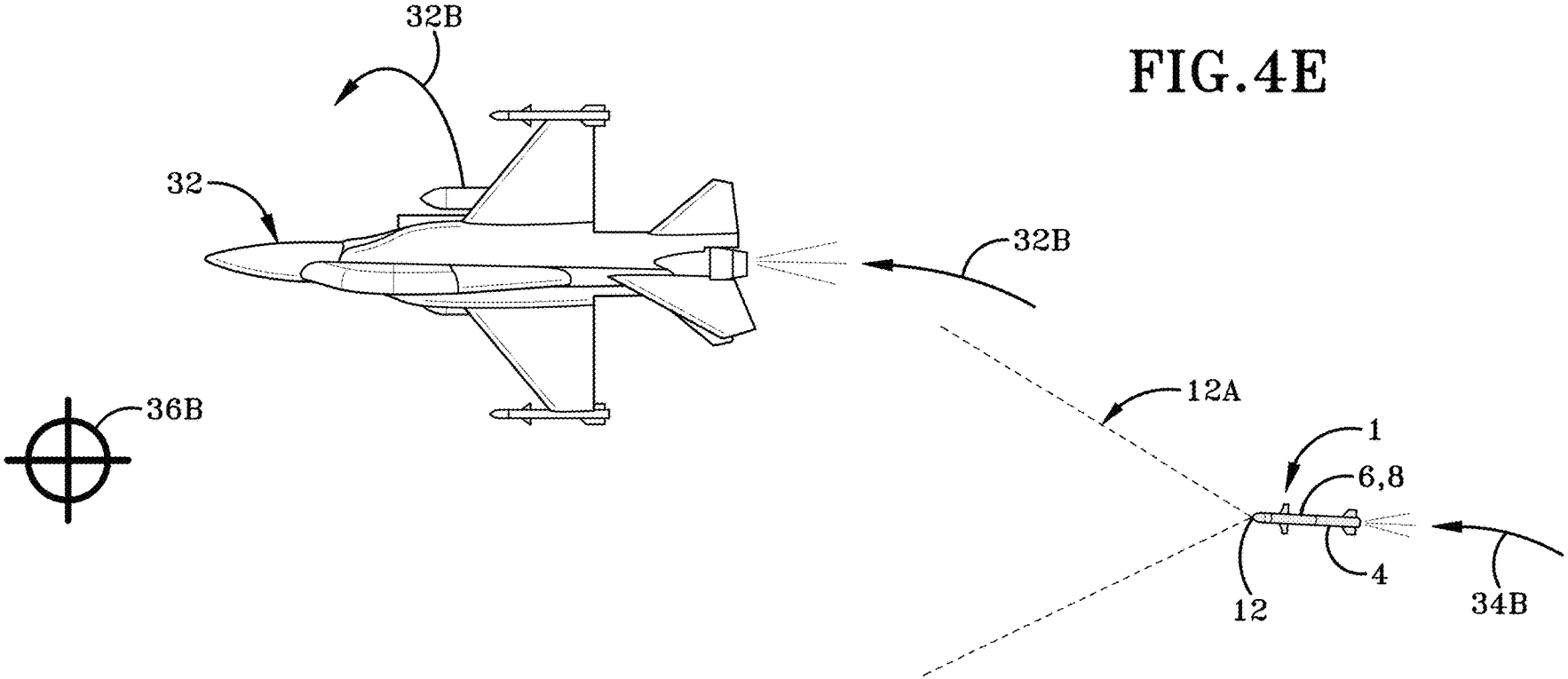
FIG. 4E illustrates another operational view similar to FIG. 4D, but the ballistic device anticipates a second aim position upon detecting a change in orientation of the desired target.
Figure 4F:
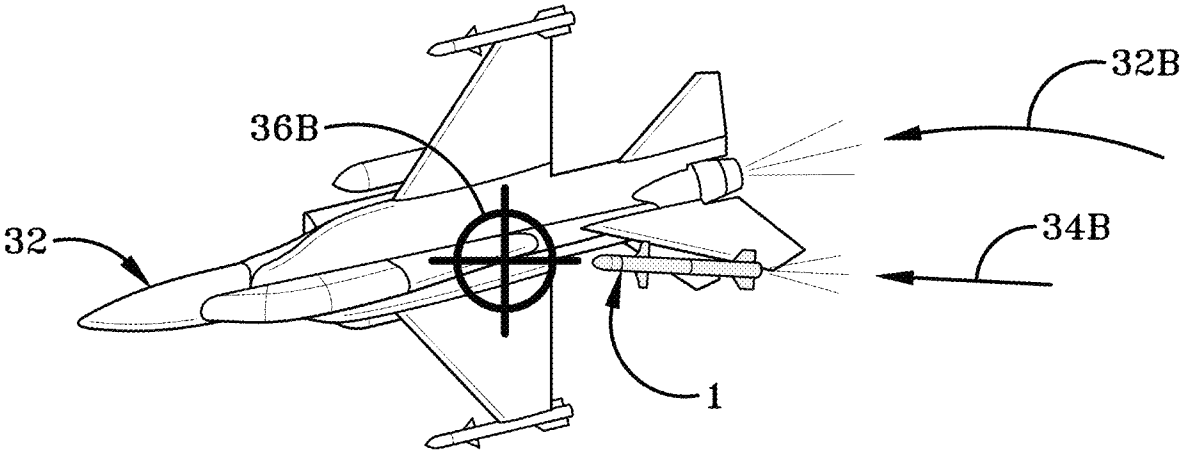
FIG. 4F illustrates another operational view similar to FIG. 4E, but the ballistic device strikes the desired target at an anticipated second position as the desired target moves in the second direction from the initial position to the first translated position or the estimated position.

As the projectile 1 continues towards the anticipated second position 34, the enemy aircraft 32 may, in another instance, keep traveling in the second direction 32B from a first translated position having the first translated orientation to a second translated position having a first translated orientation (see FIGS. 4D-4F). As best seen in FIGS. 4D-4F, the enemy aircraft 32 remains banking in the second direction 32B from the first translated position having the first translated orientation to the second translated position having the first translated orientation in order to evade the projectile 1. However, since the feed forward guidance protocol 20 is pre-loaded with such guidance laws and maneuvering tactics, the anticipated second position 34 calculated by the processor 14 with assistance from the feed forward guidance protocol 20 provides a strike on the enemy aircraft 32 with projectile 1. In this instance, however, the projectile 1 would provide a "top down" attack or strike on the canopy of the enemy aircraft 32.

While not illustrated herein, processor 14 may also execute the second set of instructions 28 instead of the first set of instructions 26 if the enemy aircraft 32 was determined to be a rotary-wing aircraft. Upon such determination, the processor 14 would then execute the second set of instructions 28 due to the second set of instructions 28 being optimized for rotary-wing aircrafts. Such calculation of the anticipated second position 34 by the processor 14 with assistance from the feed forward guidance protocol 20 for a rotary-wing aircraft is substantially similar to calculation of the anticipated second position 34 by the processor 14 with assistance from the feed forward guidance protocol 20 for a fixed-wing aircraft (e.g., enemy aircraft 32 illustrated in FIGS. 3A-4F). However, in this calculation, the guidance laws and set of guidance laws pre-loaded into the second guidance law function 28A of the second set of instructions 28 provide specific guidance laws and set of guidance laws for rotary-wing aircrafts.

Figure 5:
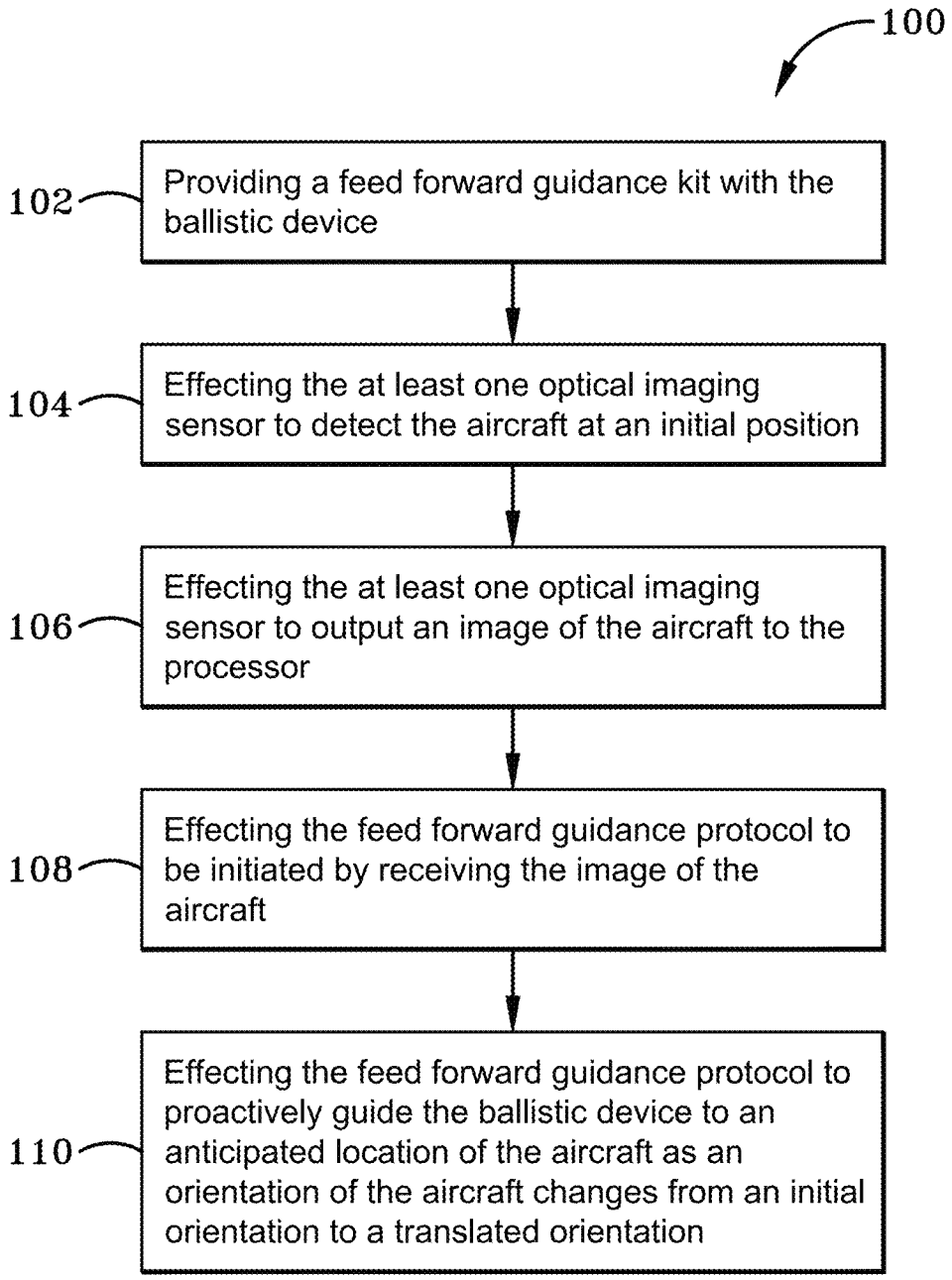
FIG. 5 illustrates an exemplary method flowchart.

FIG. 5 illustrates a method 100 for proactively guiding a ballistic device to an anticipated location of an aircraft. An initial step 102 of method 100 includes providing a feed forward guidance kit with the ballistic device, the feed forward guidance kit comprises: at least one optical imaging sensor; a processor operatively in communication with the at least one optical imaging sensor and the guidance kit; and a feed forward guidance protocol stored on a computer readable medium that is operatively in communication with the processor. Another step 104 of method 100 includes effecting the at least one optical imaging sensor to detect the aircraft at an initial position. Another step 106 of method 100 includes effecting the at least one optical imaging sensor to output an image of the aircraft to the processor. Another step 108 of method 100 includes effecting the feed forward guidance protocol to be initiated by receiving the image of the aircraft. Another step 110 of method 100 includes effecting the feed forward guidance protocol to proactively guide the ballistic device to an anticipated location of the aircraft as an orientation of the aircraft changes from an initial orientation to a translated orientation.

Optional and/or additional steps may be included in method 100 for proactively guiding a ballistic device to an anticipated location of an aircraft. Optional steps for method 100 may further include effecting an identifier function of the feed forward guidance protocol to be initiated, via the processor, in response to receiving the image of the aircraft; and effecting the identifier function of the feed forward guidance protocol to determine if the aircraft is one of a rotary-wing aircraft and a fixed-wing aircraft based on the image received. An optional step for method 100 may further include effecting a first set of instructions of the feed forward guidance protocol, via the identifier function, to be initiated by the processor. An optional step for method 100 may further include effecting a first guidance law function of the first set of instructions to load the processor with a fixed-wing guidance law. An optional step for method 100 may further include effecting an first orientation function of the first set of instructions to measure the orientation of the aircraft as the aircraft changes from the initial orientation to the translated orientation. An optional step for method 100 may further include effecting a first guidance function of the first set of instructions to proactively calculate the anticipated second position to the processor for guiding the ballistic device to the anticipated second position. An optional step for method 100 may further include effecting a second set of instructions of the feed forward guidance protocol, via the identifier function, to be initiated by the processor. An optional step for method 100 may further include effecting a second guidance law function of the second set of instructions to load the processor with a rotary-wing guidance law. An optional step for method 100 may further include effecting a second orientation function of the second set of instructions to measure the orientation of the aircraft as the aircraft changes from the initial orientation to the translated orientation. An optional step for method 100 may further include effecting a second guidance function of the second set of instructions to proactively calculate the anticipated second position to the processor for guiding the missile to the anticipated second position.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously or concurrently, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled processor, discrete logic like a processor (e.g., processor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A feed forward guidance kit for a ballistic device, the feed forward guidance kit comprising:

at least one optical imaging sensor;

a processor operatively in communication with the at least one optical imaging sensor; and a feed forward guidance protocol stored on a computer readable medium that is executable by the processor;

wherein when the at least one optical imaging sensor initially intercepts an aircraft at an initial position, the processor accesses the feed forward guidance protocol to proactively calculate an anticipated second position of the aircraft as an orientation of the aircraft changes from an initial orientation to a second orientation and based on the type of aircraft intercepted by the optical imaging sensor.

2. The feed forward guidance kit of claim 1, wherein the feed forward guidance protocol comprises:

an identifier function stored on the computer readable medium and executable by the processor to classify if the aircraft is one of a rotary-wing aircraft and a fixed-wing aircraft.

3. The feed forward guidance kit of claim 2, wherein the feed forward guidance protocol further comprises:

a guidance law function of a first set of instructions stored on the computer readable medium and executable by the processor in response to the identifier function identifying the aircraft as the fixed-wing aircraft;

wherein the guidance law function of the first set of instructions comprises of a set of fixed-wing guidance laws.

4. The feed forward guidance kit of claim 3, wherein the feed forward guidance protocol further comprises:

an orientation function of the first set of instructions stored on the computer readable medium and executable by the processor in response to the identifier function identifying the aircraft as the fixed-wing aircraft;

wherein the orientation function of the first set of instructions instructs the processor to measure the orientation of the fixed-wing aircraft as the fixed-wing aircraft changes from the initial orientation to the second orientation.

5. The feed forward guidance kit of claim 4, wherein the feed forward guidance protocol further comprises:

a guidance function of the first set of instructions stored on the computer readable medium and executable by the processor in response to the orientation function measuring the orientation of the fixed-wing aircraft;

wherein the guidance function of the first set of instructions instructs the processor to proactively calculate the anticipated second position of the fixed-wing aircraft as the orientation of the fixed-wing aircraft changes from the initial orientation to the second orientation.

6. The feed forward guidance kit of claim 2, wherein the feed forward guidance protocol further comprises:

a guidance law function of a second set of instructions stored on the computer readable medium and executable by the processor in response to the identifier function identifying the aircraft as the rotary-wing aircraft;

wherein the guidance law function of the second set of instructions comprises of a set of rotary-wing guidance laws.

7. The feed forward guidance kit of claim 6, wherein the feed forward guidance protocol further comprises:

an orientation function of the second set of instructions stored on the computer readable medium and executable by the processor in response to the identifier function identifying the aircraft as the rotary-wing aircraft;

wherein the orientation function of the second set of instructions instructs the processor to measure the orientation of the rotary-wing aircraft as the rotary-wing aircraft changes from the initial orientation to the second orientation.

8. The feed forward guidance kit of claim 7, wherein the feed forward guidance protocol further comprises:

a guidance function of the second set of instructions stored on the computer readable medium and executable by the processor in response to the orientation function measuring the orientation of the rotary-wing aircraft;

wherein the guidance function of the second set of instructions instructs the processor to proactively calculate the anticipated second position of the rotary-wing aircraft as the orientation of the rotary-wing aircraft changes from the initial orientation to the second orientation.

9. A method for enhancing target engagement of a ballistic projectile, comprising step of:

providing a ballistic projectile having at least one optical imaging sensor and a processor operatively in communication with the at least one optical imaging sensor, wherein the processor is configured to execute a feed forward guidance protocol loaded on a computer readable medium which, when executed by the processor, causes the processor to:

command the at least one optical image sensor to detect a targeted aircraft;

receive an image of the targeted aircraft at an initial orientation outputted by the at least one optical imaging sensor; and proactively guide the ballistic projectile to an anticipated position of the targeted aircraft as the orientation of the targeted aircraft changes from the initial orientation to a second orientation.

10. The method of claim 9, wherein when the feed forward guidance protocol is executed by the processor, the processor is further caused to:

classify if the targeted aircraft is one of a rotary-wing aircraft and a fixed-wing aircraft upon executing an identifier function loaded on the computer readable medium.

11. The method of claim 10, wherein when the feed forward guidance protocol is executed by the processor, the processor is further caused to:

load a set of guidance laws corresponding to the fixed-wing aircraft when identified by execution of the identifier function.

12. The method of claim 11, wherein when the feed forward guidance protocol is executed by the processor, the processor is further caused to:

load an orientation law corresponding to the fixed-wing aircraft when identified by execution of the identifier function; and measure the orientation of the fixed-wing aircraft as the fixed-wing aircraft changes from the initial orientation to the second orientation.

13. The method of claim 12, wherein when the feed forward guidance protocol is executed by the processor, the processor is further caused to:

load a guidance function to proactively calculate the anticipated position of the fixed-wing aircraft as the orientation of the fixed-wing aircraft changes from the initial orientation to the second orientation.

14. The method of claim 10, wherein when the feed forward guidance protocol is executed by the processor, the processor is further caused to:

load a set of guidance laws corresponding to the rotary-wing aircraft when identified by execution of the identifier function.

15. The method of claim 14, wherein when the feed forward guidance protocol is executed by the processor, the processor is further caused to:

load an orientation law corresponding to the rotary-wing aircraft when identified by execution of the identifier function; and measure the orientation of the rotary-wing aircraft as the rotary-wing aircraft changes from the initial orientation to the second orientation.

16. The method of claim 15, wherein when the feed forward guidance protocol is executed by the processor, the processor is further caused to:

load a guidance function to proactively calculate the anticipated position of the rotary-wing aircraft as the orientation of the rotary-wing aircraft changes from the initial orientation to the second orientation.

17. At least one non-transitory computer readable medium comprising instructions which, when executed by a computing system, cause the computing system to perform operations comprising:

executing, by a processor, a first step stored on the computer readable medium that instructs the processor to classify the type of aircraft intercepted by at least one optical imaging sensor of the ballistic device;

executing, by the processor, a second step stored on the computer readable medium that comprises of at least one set of guidance laws corresponding to the type of aircraft identified by the first step;

executing, by the processor, a third step stored on the computer readable medium that comprises at least one orientation law corresponding to the type of aircraft identified by the identifier function to instruct the processor to measure the orientation of the aircraft as the aircraft changes from an initial orientation to a second orientation; and executing, by the processor, a fourth step stored on the computer readable medium that comprises of at least one guidance function to instruct the processor to proactively calculate an anticipated position of the aircraft as the orientation of the aircraft changes from the initial orientation to the second orientation.

18. The at least one non-transitory computer readable medium of claim 17 wherein the second step comprises performing the operation of:

executing, by the processor, a first set of guidance laws corresponding to a fixed-wing aircraft identified by the first step; or executing, by the processor, a second set of guidance laws corresponding to a rotary-wing aircraft identified by the first step.

19. The at least one non-transitory computer readable medium of claim 17 wherein the third step comprises performing the operation of:

executing, by the processor, a first orientation law corresponding to a fixed-wing aircraft identified by the first step to instruct the processor to measure the orientation of the fixed-wing aircraft as the fixed-wing aircraft changes from the initial orientation to the second orientation; or executing, by the processor, a second orientation law corresponding to a rotary-wing aircraft identified by the first step to instruct the processor to measure the orientation of the rotary-wing aircraft as the rotary-wing aircraft changes from the initial orientation to the second orientation.

20. The at least one non-transitory computer readable medium of claim 17 wherein the fourth step comprises performing the operation of:

executing, by the processor, a first guidance function to instruct the processor to proactively calculate an anticipated position of a fixed-wing aircraft as the orientation of the fixed-wing aircraft changes from the initial orientation to the second orientation; or executing, by the processor, a second guidance function to instruct the processor to proactively calculate an anticipated position of a rotary-wing aircraft as the orientation of the rotary-wing aircraft changes from the initial orientation to the second orientation.

* * * * *